US010498056B2

(12) United States Patent
Miyazaki et al.

(10) Patent No.: US 10,498,056 B2
(45) Date of Patent: Dec. 3, 2019

(54) MOUNTING METAL FITTING, CONNECTOR AND CONNECTION SYSTEM

(71) Applicant: PANASONIC INTELLECTUAL PROPERTY MANAGEMENT CO., LTD., Osaka (JP)

(72) Inventors: Yoji Miyazaki, Mie (JP); Yuki Minai, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/096,388

(22) PCT Filed: Apr. 18, 2017

(86) PCT No.: PCT/JP2017/015526

§ 371 (c)(1),
(2) Date: Oct. 25, 2018

(87) PCT Pub. No.: WO2017/188053

PCT Pub. Date: Nov. 2, 2017

(65) Prior Publication Data

US 2019/0148855 A1 May 16, 2019

(30) Foreign Application Priority Data

Apr. 28, 2016 (JP) ..... 2016-091929
Apr. 28, 2016 (JP) ..... 2016-091930
(Continued)

(51) Int. Cl.
*H01R 12/71* (2011.01)
*H01R 13/6595* (2011.01)
(Continued)

(52) U.S. Cl.
CPC ..... *H01R 12/71* (2013.01); *H01R 12/52* (2013.01); *H01R 12/7029* (2013.01);
(Continued)

(58) Field of Classification Search
CPC ..... H01R 12/71
See application file for complete search history.

(56) References Cited

U.S. PATENT DOCUMENTS 6,000,968 A 12/1999 Hagiwara
2003/0190827 A1* 10/2003 Korsunsky ..... H05K 3/308 439/82
(Continued)

FOREIGN PATENT DOCUMENTS

CN 105322319 2/2016
EP 1739796 1/2007
(Continued)

OTHER PUBLICATIONS

International Search Report issued in PCT/JP2017/015527, dated Jul. 18, 2018, along with an English translation thereof.
(Continued)

*Primary Examiner* — James Harvey
(74) *Attorney, Agent, or Firm* — Greenblum & Bernstein, P.L.C

(57) ABSTRACT

The housing possesses a bottom wall and a periphery wall that surrounds a periphery of the bottom wall and is composed of a pair of first side walls retaining contacts with the contacts aligned in an arrangement direction, and a pair of second side walls, one of which connects one ends of the pair of first side walls, another of which connects other ends of the pair of first side walls. The mounting members possess a first mounting section covering at least part of each region, in which no contacts are aligned, of the first side walls, and a second mounting section that is separated from the first
(Continued)

mounting section and covers at least part of the second side walls.

19 Claims, 14 Drawing Sheets

(30) Foreign Application Priority Data

Dec. 27, 2016 (JP) ..... 2016-254528
Dec. 27, 2016 (JP) ..... 2016-254529

(51) Int. Cl.

| | |
|---|---|
| ***H01R 12/52*** | (2011.01) |
| ***H01R 12/70*** | (2011.01) |
| ***H01R 13/20*** | (2006.01) |
| ***H01R 13/627*** | (2006.01) |
| ***H01R 13/64*** | (2006.01) |
| ***H01R 13/6591*** | (2011.01) |
| ***H01R 24/60*** | (2011.01) |
| ***H01R 24/78*** | (2011.01) |
| *H01R 13/6582* | (2011.01) |

(52) U.S. Cl.
CPC ..... *H01R 13/20* (2013.01); *H01R 13/6273* (2013.01); *H01R 13/6275* (2013.01); *H01R 13/64* (2013.01); *H01R 13/6591* (2013.01); *H01R 13/6595* (2013.01); *H01R 24/60* (2013.01); *H01R 24/78* (2013.01); *H01R 13/6582* (2013.01)

(56) References Cited

U.S. PATENT DOCUMENTS

| | | | | |
|---|---|---|---|---|
| 2007/0049063 | A1 | 3/2007 | Endo | |
| 2010/0029134 | A1 | 2/2010 | Matsuzaki et al. | |
| 2013/0012039 | A1 | 1/2013 | Nose et al. | |
| 2013/0203272 | A1* | 8/2013 | Miyazaki | H01R 12/707 439/65 |
| 2013/0323971 | A1* | 12/2013 | Kimura | H01R 12/71 439/607.22 |
| 2013/0337695 | A1* | 12/2013 | Malehorn, II | H01R 24/84 439/658 |
| 2013/0344710 | A1* | 12/2013 | Sasaki | H01R 12/716 439/65 |
| 2014/0004745 | A1* | 1/2014 | Komoto | H01R 12/71 439/626 |
| 2014/0227910 | A1 | 8/2014 | Tanaka et al. | |
| 2014/0227911 | A1* | 8/2014 | Lim | H01R 12/71 439/660 |
| 2014/0364003 | A1 | 12/2014 | Yunoki | |
| 2015/0263464 | A1 | 9/2015 | Arichika et al. | |
| 2015/0303597 | A1 | 10/2015 | He | |
| 2015/0380845 | A1 | 12/2015 | Goto et al. | |
| 2016/0013573 | A1 | 1/2016 | Miyazaki et al. | |
| 2016/0226173 | A1 | 8/2016 | Miyazaki | |
| 2016/0268732 | A1 | 9/2016 | Arichika et al. | |
| 2017/0365944 | A1* | 12/2017 | Yoshioka | H01R 12/71 |

FOREIGN PATENT DOCUMENTS

| | | | |
|---|---|---|---|
| EP | 1965466 | | 9/2008 |
| EP | 2665132 | | 11/2013 |
| JP | 2007-66887 | A | 3/2007 |
| JP | 2008-108559 | A | 5/2008 |
| JP | 2011-124010 | A | 6/2011 |
| JP | 2013-65542 | A | 4/2013 |
| JP | 2014-222672 | A | 11/2014 |
| JP | 2014-239002 | | 12/2014 |
| JP | 2015-106529 | A | 6/2015 |
| JP | 2015-115200 | A | 6/2015 |
| JP | 5809198 | B2 | 9/2015 |
| WO | 2015/063817 | A1 | 5/2015 |

OTHER PUBLICATIONS

International Search Report issued in PCT/JP2017/015526, dated Jul. 25, 2017, along with an English translation thereof.
Written Opinion issued in PCT/JP2017/015527, dated Jul. 18, 2018, along with an English translation thereof.
Written Opinion issued in PCT/JP2017/015526, dated Jul. 25, 2017, along with an English translation thereof.
Official Communication issued in European Patent Office (EPO) Patent Application No. 17789339.3, dated Mar. 26, 2019.
Official Communication issued in European Patent Office (EPO) Patent Application No. 17789338.5, dated Mar. 26, 2019.
Office Action issued in China Counterpart Patent Appl. No. 201780025747.4, dated Aug. 28, 2019, along with an English translation thereof.

* cited by examiner

MOUNTING METAL FITTING, CONNECTOR AND CONNECTION SYSTEM

TECHNICAL FIELD

The invention relates generally to mounting metal fittings, connectors and connection systems and, more particularly, to a mounting metal fitting to be attached to a housing of a connector, a connector and a connection system.

BACKGROUND ART

A known related mounting metal fitting to be attached to a housing of a connector is disclosed in, for example Patent Document 1. In an electrical connector (a connector) which a guide metal fitting (a mounting metal fitting) is attached to, described in Patent Document 1, a housing possesses a bottom wall and a periphery wall composed of a pair of side walls and a pair of end walls. The pair of side walls is elongated in a lengthwise direction of the housing. One of the pair of end walls connects one ends, in a lengthwise direction, of the pair of side walls, while another of the pair of end walls connects other ends, in the lengthwise direction, of the pair of side walls. The guide metal fitting includes a pair of attached sections that is respectively attached to end sides of the pair of side walls, and a connection section that connects the pair of attached sections.

In the related connector, it is desired to improve the strength of the housing by the mounting metal fitting to be attached to the housing.

CITATION LIST

Patent Literature

Patent Literature 1: JP 5809198 B2

SUMMARY OF INVENTION

With the foregoing in view, it is an object of the present invention to provide a mounting metal fitting, a connector and a connection system, capable of improving strength of a housing.

A mounting metal fitting according to an aspect of the present invention includes mounting members to be attached to a housing of a connector. The housing possesses a bottom wall and a periphery wall surrounding a periphery of the bottom wall. The periphery wall is composed of a pair of first side walls and a pair of second side walls. The pair of first side walls retains contacts with the contacts aligned in an arrangement direction. One of the pair of second side walls connects one ends of the pair of first side walls, while another of the pair of second side walls connects other ends of the pair of first side walls. The mounting members possess a first mounting section and a second mounting section. The first mounting section covers at least part of a region, in which no contacts are aligned, of a first side wall that is one of the pair of first side walls. The second mounting section is separated from the first mounting section, and covers at least part of a second side wall that is at least one of the pair of second side walls.

A connector according to an aspect of the present invention includes the mounting metal fitting, the housing to which the mounting metal fitting is attached, and the contacts retained by each of the pair of first side walls.

A connection system according to an aspect of the present invention possesses the connector, and a mating connector.

The mating connector possesses mating contacts that are electrically connected to the contacts.

DESCRIPTION OF EMBODIMENTS (1) Schema

Figure 1A:
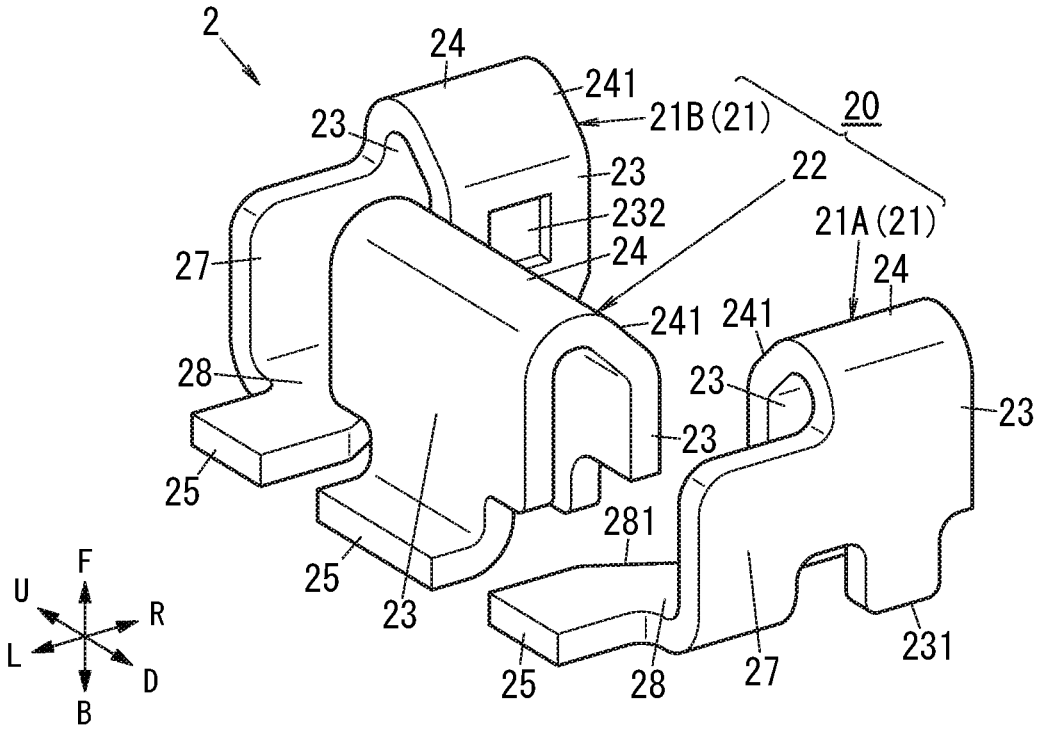
FIG. 1A is a perspective view of a mounting metal fitting in accordance with an embodiment of the present invention.
Figure 1B:
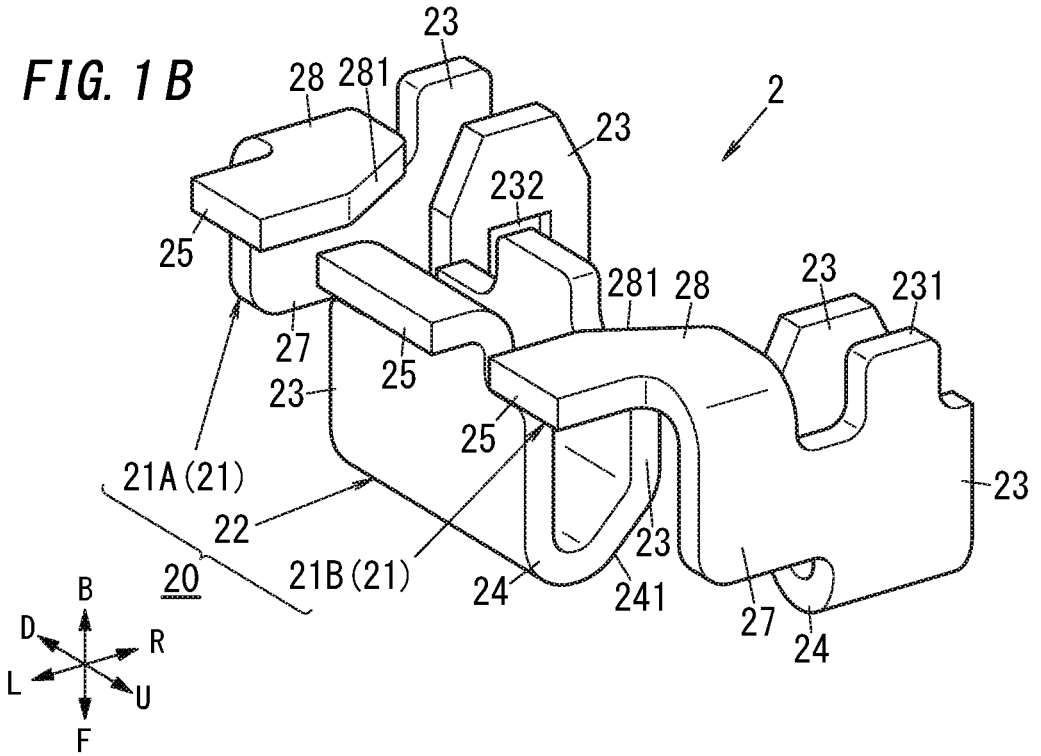
FIG. 1B is a perspective view of the mounting metal fitting.
Figure 2B:
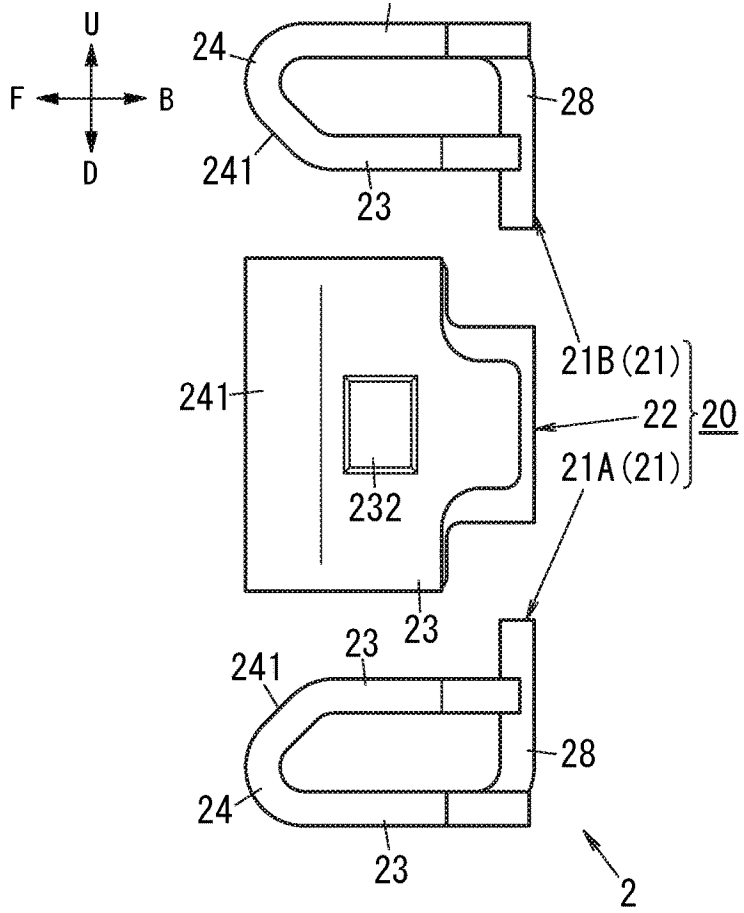
FIG. 2B is a right side view of the mounting metal fitting.
Figure 2A:
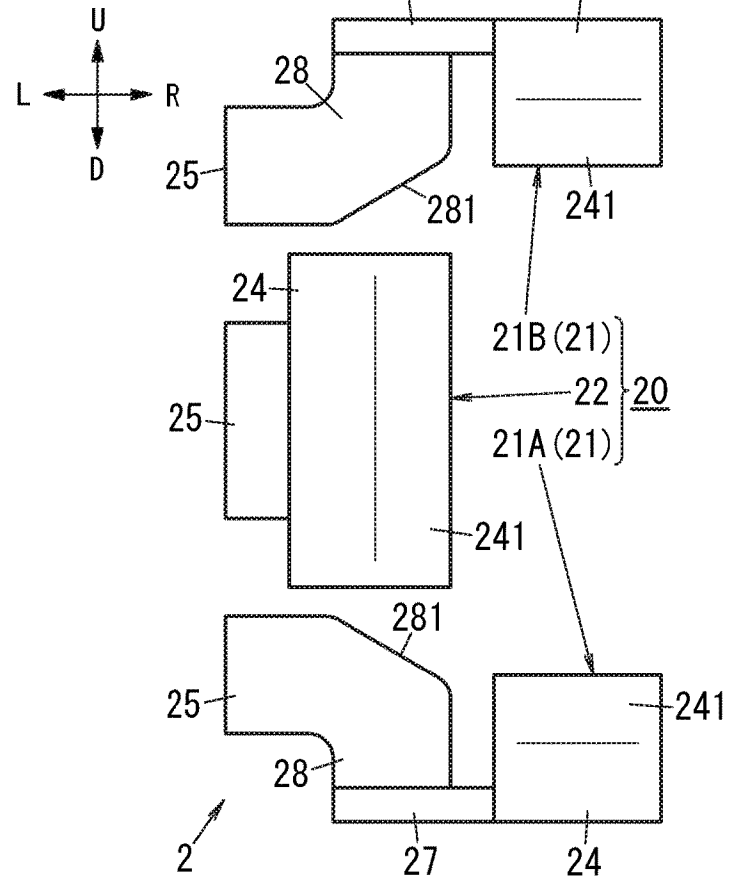
FIG. 2A is a front view of the mounting metal fitting.

A mounting metal fitting 2 and a connector 101 according to an embodiment will be explained below with reference to FIGS. 1A to 6. For example, the connector 101 according to the present embodiment is attached to a substrate such as a printed circuit board or a flexible printed circuit board. For example, the connector 101 is provided in order to electrically connect substrates installed in a portable terminal such as a smartphone. The usage of the connector 101 is however not limited thereto. The connector 101 may be applied to an electronic device, other than the portable terminal, such as, e.g., a camera module. In addition, the connector 101 is not limited to the application to the electrical connection between the substrates, but may be applied to the electrical connection between parts, such as between a substrate and a display or between a substrate and a battery.

As shown in FIGS. 3 to 6, the connector 101 includes a housing 1 and the mounting metal fitting 2 to be attached to the housing 1. The housing 1 possesses a bottom wall 11 and a periphery wall 12 surrounding a periphery of the bottom wall 11. The periphery wall 12 is composed of a pair of first side walls 121 and a pair of second side walls 122. The pair of first side walls 121 retains contacts 3 with the contacts 3 aligned in an arrangement direction. One of the pair of second side walls 122 connects one ends of the pair of first side walls 121, while another of the pair of second side walls 122 connects other ends of the pair of first side walls 121. A dimension of the housing 1 in a thickness direction thereof is, for example several mm or less. A dimension of the housing 1 in a lengthwise direction thereof is also, for example ten and several mm. In addition, a dimension of the housing 1 in a widthwise direction thereof is, for example several mm. Furthermore, the contacts 3 are aligned at intervals (at a pitch) of, for example several tenths of a mm. In the present embodiment, the contacts 3 are aligned at regular intervals, but may be aligned at irregular intervals.

As shown in FIGS. 1A to 2B, the mounting metal fitting 2 includes mounting members 20 to be attached to the housing 1. The mounting members 20 possess a first mounting section 21 and a second mounting section 22. The first mounting section 21 covers at least part of a region, in which no contacts 3 are aligned, of a first side wall 121 that is one of the pair of first side walls 121. The second mounting section 22 is separated from the first mounting section 21, and covers at least part of a second side wall 122 that is at least one of the pair of second side walls 122.

In the mounting metal fitting 2 according to the present embodiment, the first mounting section 21 and the second mounting section 22 are separated from each other. Accordingly, even if stress is exerted on one of the first mounting section 21 and the second mounting section 22, the stress is hardly transmitted to the other. The mounting metal fitting 2 according to the present embodiment is therefore hard to deform as compared with the integral configuration of the first mounting section 21 and the second mounting section 22, thereby enabling reduction in part of the housing 1 which stress is exerted on and improvement in the strength of the housing 1.

(2) Details

A configuration of the connector 101 according to the present embodiment will be explained in detail below. The mounting metal fitting 2 will be described in detail in "(3) Mounting metal fitting". In the explanation below, a first direction (a fore-and-aft direction) is regarded as the thickness direction of the housing 1, a second direction (a vertical direction) is regarded as the widthwise direction of the housing 1, and a third direction (a lateral direction) is regarded as the lengthwise direction of the housing 1. Note that in FIGS. 1A to 14B, such directions (upward (U), downward (D), left (L), right (R), frontward (F) and backward (B)) are represented by arrows, but the arrows are depicted for the assistance of the explanation and have no entity. The directions described above are not intended to limit the usage of the connector 101 according to the present embodiment.

The connector 101 according to the present embodiment is a socket (a female connector), and includes the housing 1, a pair of mounting metal fittings 2, one or more (herein, thirty four) contacts 3, and a pair of power terminals 4 as shown in FIGS. 3 to 8. The pair of mounting metal fittings 2 is attached to both ends of the housing 1 in the lengthwise direction (the lateral direction), respectively. Each of the pair of mounting metal fittings 2 also includes mounting members 20 that possess two first mounting sections 21 and one second mounting section 22.

As shown in FIGS. 3 to 6, the housing 1 is formed of resin material that is electrically nonconductive and has a rectangular cuboid shape that is flat and elongated in the lateral direction. In the present embodiment, the housing 1 is insert molded along with the pair of mounting metal fittings 2 as inserted components. The housing 1 possesses the bottom wall 11, the periphery wall 12 and a base 13. The bottom wall 11 has a board shape that is elongated in the lateral direction, and forms a bottom of the housing 1.

The periphery wall 12 protrudes forward from the periphery of the bottom wall 11, and has a rectangular frame shape in plan view. That is, the periphery wall 12 is formed to surround the periphery of the bottom wall 11. Specifically, the periphery wall 12 is composed of the pair of first side walls 121 and the pair of second side walls 122. The pair of first side walls 121 is a pair of walls of the periphery wall 12 along the lengthwise direction of the housing 1. Contacts 3 and a power terminal 4 are individually housed in storage sections 15 to be described later in each of the pair of first side walls 121, and thereby retained with the contacts 3 and the power terminal 4 aligned in one direction (the lateral direction). That is, each of the pair of first side walls 121 retains contacts 3 with the contacts 3 aligned in the arrangement direction (the lateral direction). In the present embodiment, each of the pair of first side walls 121 retains seventeen contacts 3. Each of the pair of first side walls 121 also retains one power terminal 4.

A first mounting section 21 of the mounting metal fitting 2 is attached to each end of the pair of first side walls 121 in the lengthwise direction (the lateral direction). A second mounting section 22 of the mounting metal fitting 2 is also attached to each of the pair of second side walls 122. In short, the mounting members 20 of one mounting metal fitting 2 are composed of two first mounting sections 21 and one second mounting section 22 that are on one end (a left end) side of the housing 1 in the lengthwise direction (the lateral direction). Similarly, the mounting members 20 of another mounting metal fitting 2 are composed of two first mounting sections 21 and one second mounting section 22 that are on another end (a right end) side of the housing 1 in the lengthwise direction (the lateral direction).

The base 13 has a rectangular cuboid shape that is elongated in the lateral direction, and protrudes forward from a center of the bottom wall 11. Part surrounded by the bottom wall 11, the periphery wall 12 and the base 13 forms a mating cavity 14 that allows a mating connector 102 to be fit in. Specifically, a pair of first side walls 121A and a pair of second side walls 122A, to be described later, of the mating connector 102 are fit in the mating cavity 14. Thus, the connector 101 is connected with the mating connector 102.

Each end face, facing the mating cavity 14, of both ends of the base 13 in the lengthwise direction thereof (the lateral direction) is a standing face 131 that is put upright from the bottom wall 11 along the thickness direction of the housing 1 (the fore-and-aft direction). Each corner, on the opposite side to the bottom wall 11 in the thickness direction of the housing 1 (on the front side), of both the ends of the base 13 in the lengthwise direction thereof is chamfered along the widthwise direction of the housing 1, thereby forming an inclined surface 132. Thus, the present embodiment enables the inclined surfaces 132 to guide a mating-side mounting metal fitting 2A of the mating connector 102 (to be described later) into the mating cavity 14. The present embodiment also enables the standing faces 131 to limit movement of the mating-side mounting metal fitting 2A (movement along the lengthwise direction of the housing 1) with the connector 101 connected with the mating connector 102. Thus, in the present embodiment, it is possible to improve a connection strength between the connector 101 and the mating connector 102.

The housing 1 is formed with two or more (here, 36) storage sections 15 corresponding one-to-one to the contacts 3 and the pair of power terminals 4. Each of the storage sections 15 pierces though the bottom wall 11 along the thickness direction thereof (the fore-and-aft direction). Each of the contacts 3 and the pair of power terminals 4 is inserted into a storage section 15 from backside to be fit in the storage section 15.

The storage sections 15 are arranged with the storage sections 15 divided down the middle on both upper and lower sides of the base 13. The storage sections 15 on both the upper and lower sides of the base 13 are aligned at regular intervals along the lengthwise direction of the housing 1 (the lateral direction). Here, one power terminal 4 of the pair of power terminals 4 is housed in the storage section 15 at the leftmost side of the storage sections 15 on the lower side of the base 13. Another power terminal 4 of the pair of power terminals 4 is housed in the storage section 15 at the rightmost side of the storage sections 15 on the upper side of the base 13.

In the present embodiment, each of the pair of power terminals 4 is accordingly retained by the housing 1 so as to be arranged in order of the first mounting section 21, the power terminal 4 and the contacts 3. In other words, in the present embodiment, the mounting metal fitting 2 is attached to the housing 2 so that a distance between the mounting metal fitting 2 and the power terminal 4 is equal to or less than a distance between the mounting metal fitting 2 and the contact 3, closest to the mounting metal fitting 2, of the contacts 3. Furthermore, in the present embodiment, the pair of power terminals 4 (two power terminals 4) is retained by the housing so as to be, as seen from the front side (in plan view), invariant under a point reflection through a center of the housing 1.

Figure 7:
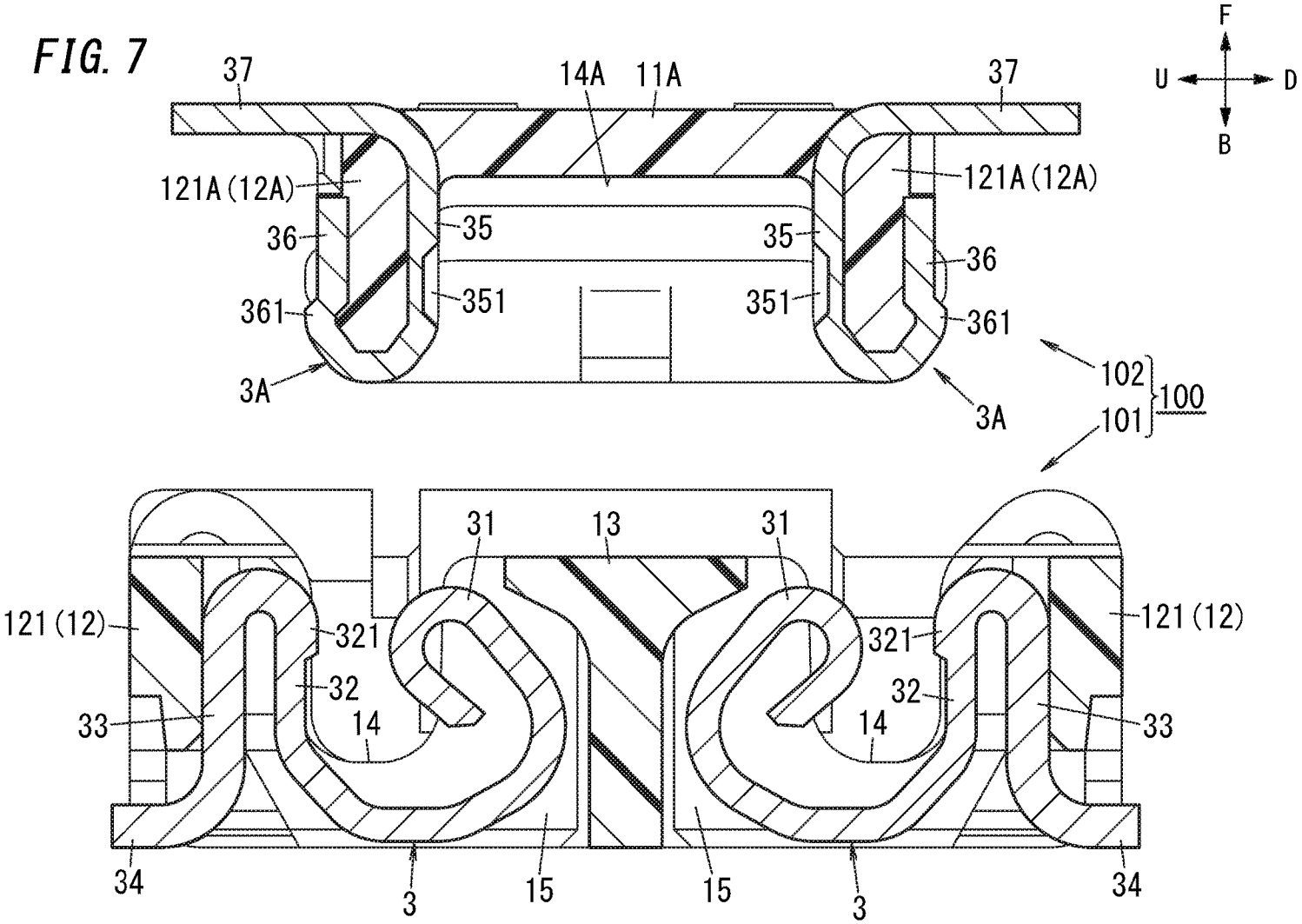
FIG. 7 is a sectional view of a connection system, before the connector is connected with a mating connector, in accordance with an embodiment of the present invention.
Figure 8:
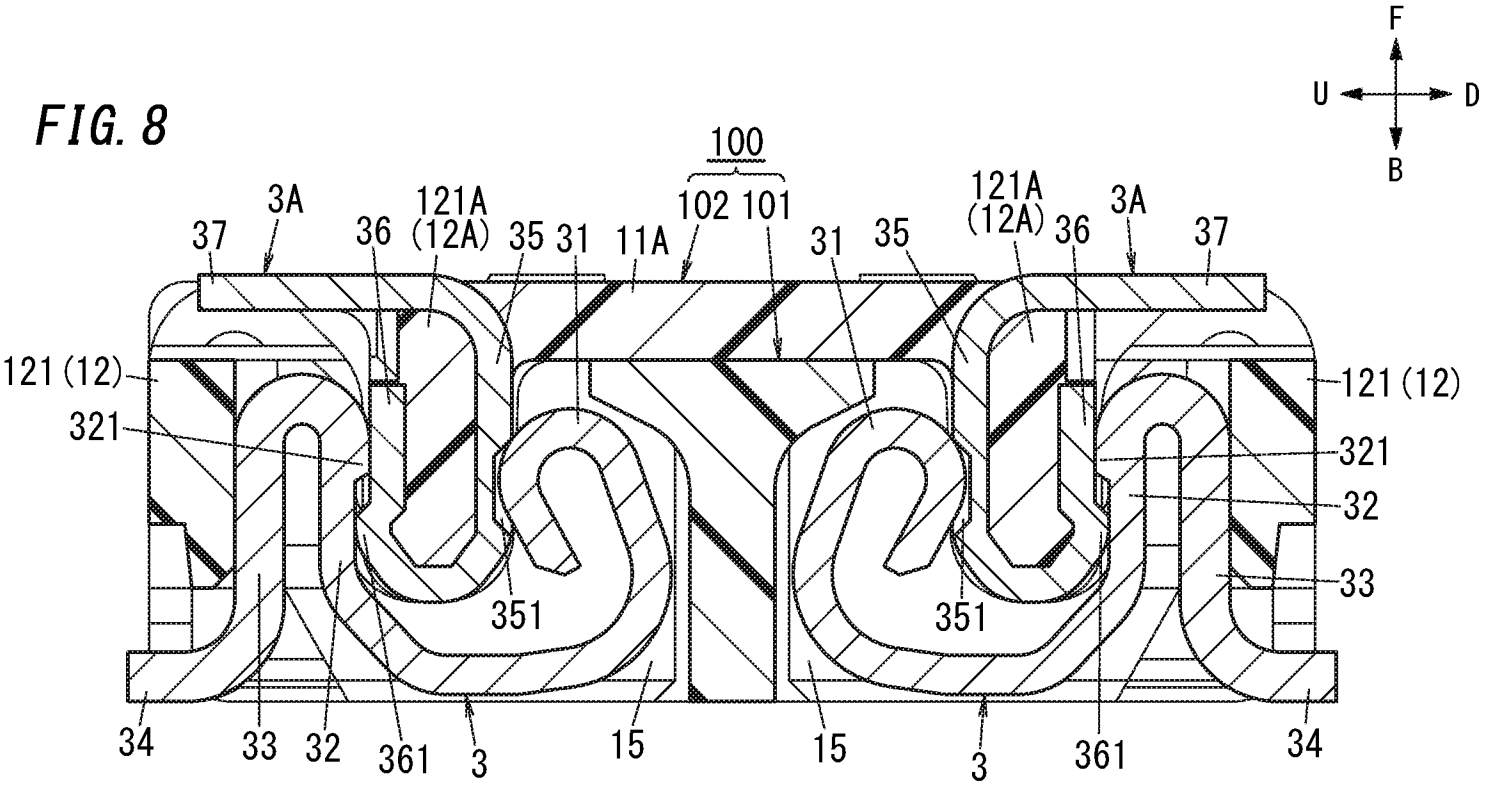
FIG. 8 is a sectional view of the connection system with the connector connected with the mating connector.
Figure 9:
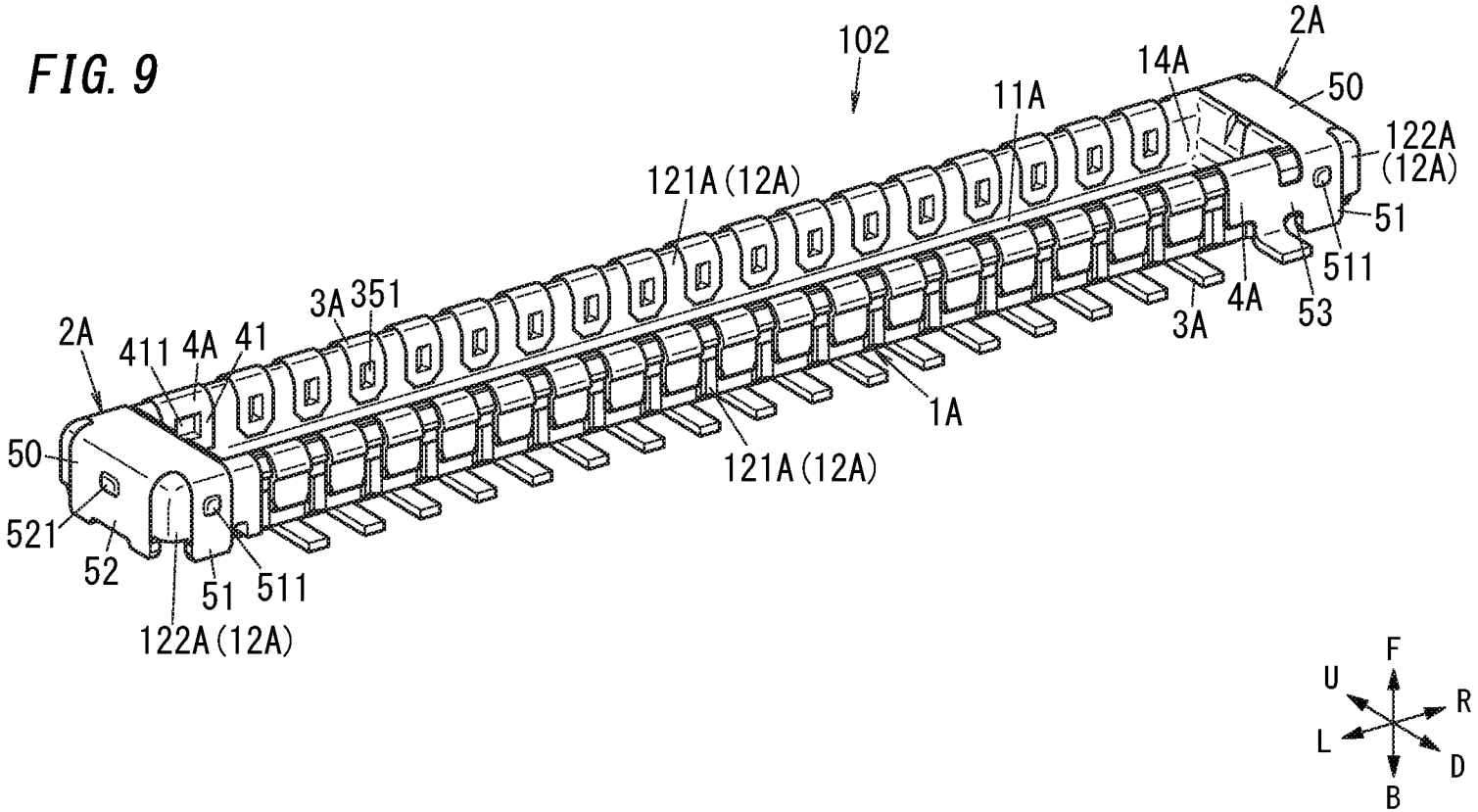
FIG. 9 is a perspective view of the mating connector in the connection system.
Figure 10:
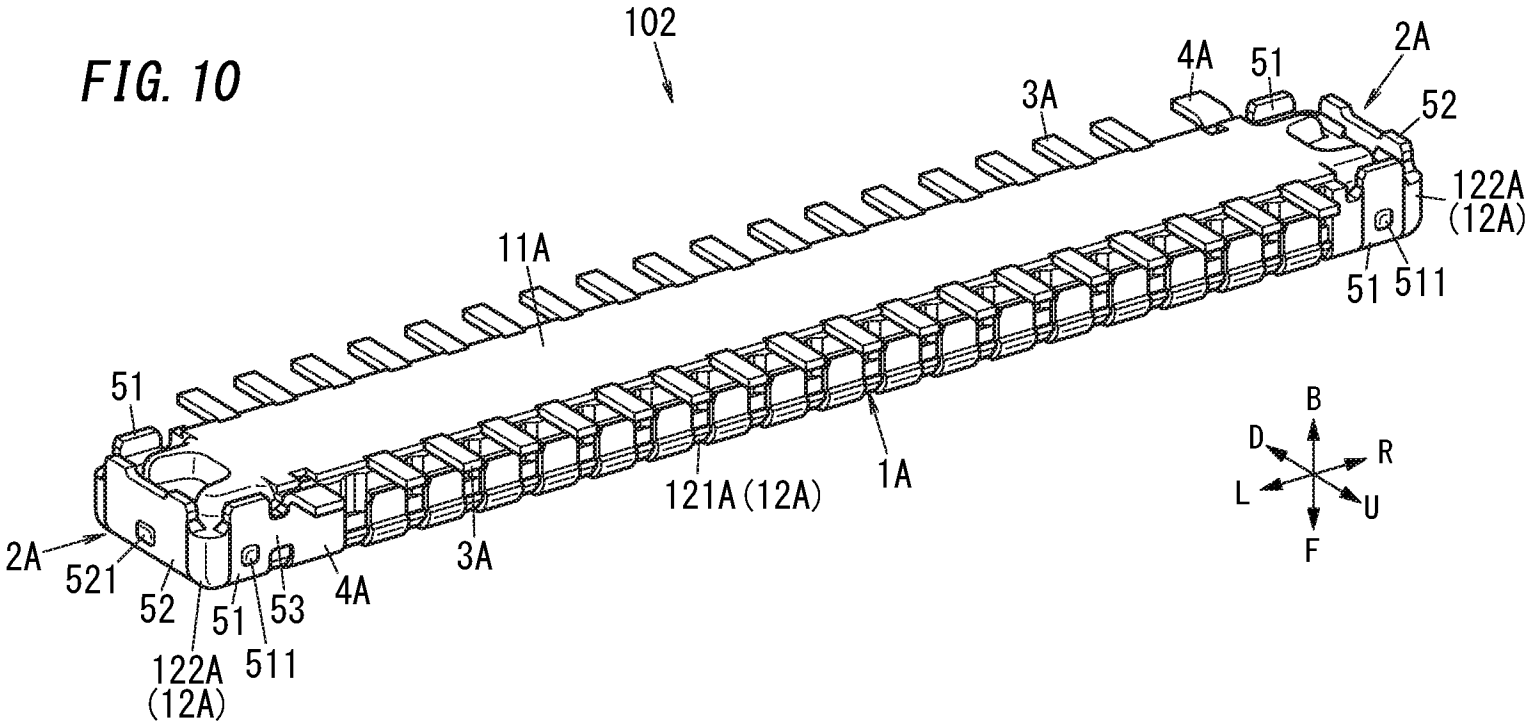
FIG. 10 is a perspective view of the mating connector with its front and back reversed, in the connection system.
Figure 11:
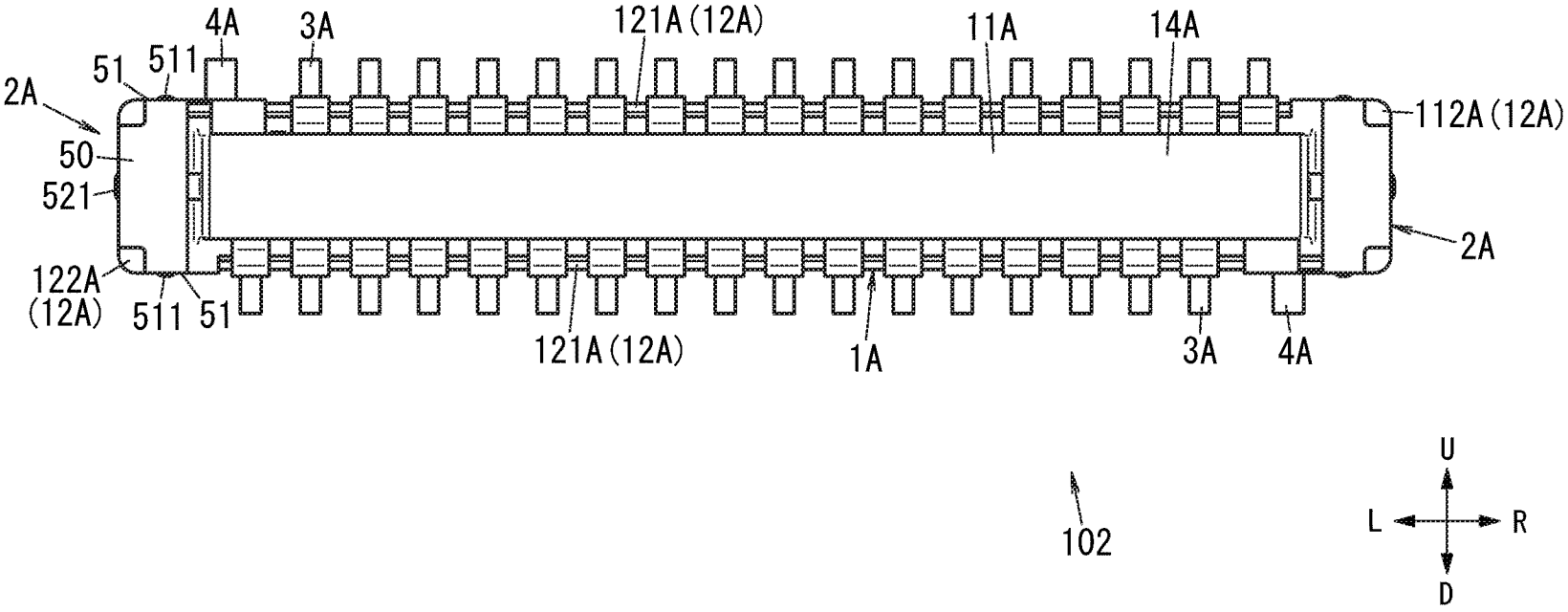
FIG. 11 is a front view of the mating connector in the connection system.
Figure 12:
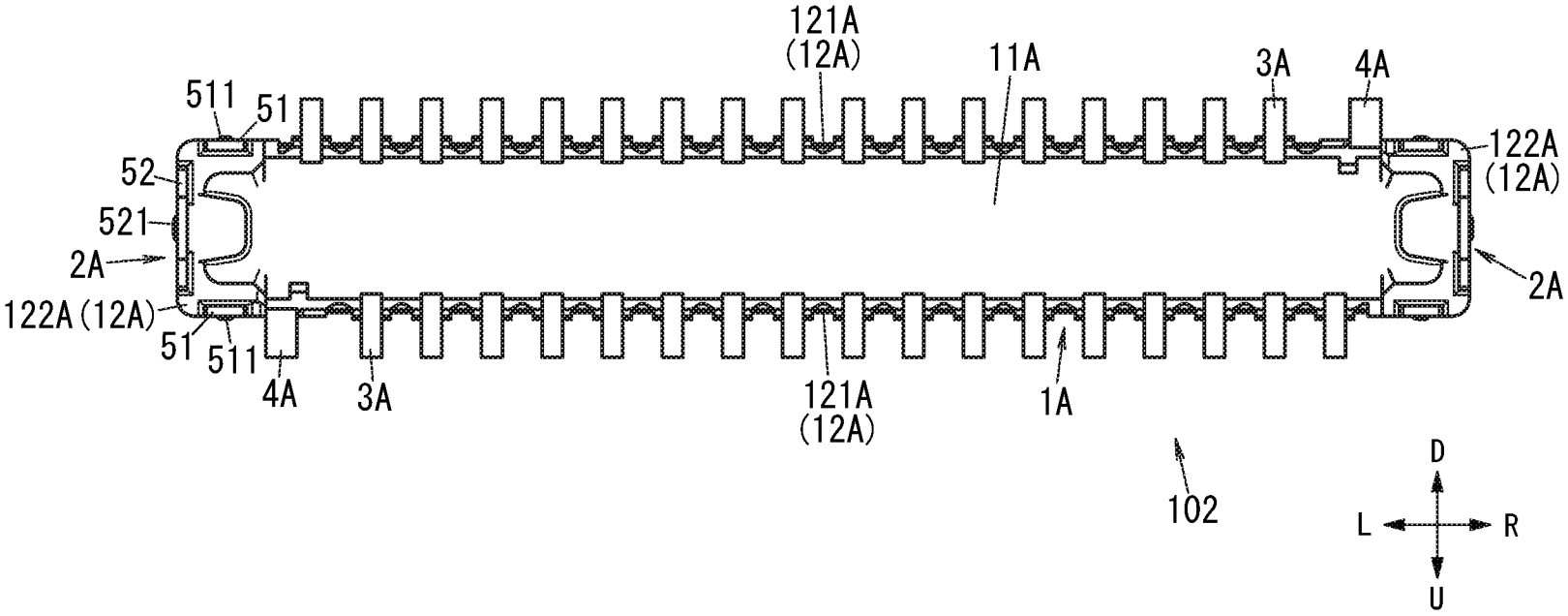
FIG. 12 is a back view of the mating connector in the connection system.

Each of the contacts 3 serves as a terminal for signal transmission. Each of power terminals 4 also serves as a terminal to be electrically connected to a power supply. Each of the contacts 3 and the power terminals 4 is formed by bending a strip metal plate. The contacts 3 are also gold-plated. As shown in FIGS. 7 and 8, each of the contacts 3 possesses a spring piece 31, a rising piece 32, a falling piece 33 and a terminal piece 34 that are formed integrally. In the same way as the contacts 3, each of the power terminals 4 is formed with a spring piece 31, a rising piece 32, a falling piece 33 and a terminal piece 34.

A tip of the spring piece 31 is curved in the shape of a horseshoe, and is flexible in the widthwise direction of the housing 1 (the vertical direction). The spring piece 31 is configured to, in a state where contacts 3A of the mating connector 102 are inserted into the mating cavity 14, be pushed by a corresponding contact 3A, thereby exerting elastic force toward the corresponding contact 3A.

The rising piece 32 has a plate shape elongated in the thickness direction of the housing 1 (the fore-and-aft direction). A first end (back end) of the rising piece 32 is formed integrally with the spring piece 31. The rising piece 32 is configured to, in the state where the contacts 3A of the mating connector 102 are inserted into the mating cavity 14, be in contact with the corresponding contact 3A.

The rising piece 32 is also formed integrally with a protrusion 321 protruding toward the spring piece 31. In the state where the contacts 3A of the mating connector 102 are inserted into the mating cavity 14, the protrusion 321 is arranged in the fore-and-aft direction along with a protrusion 361 to be described later of the corresponding contact 3A, and set further forward than the protrusion 361 of the corresponding contact 3A. Accordingly, as long as the mating connector 102 is not pulled out from the mating cavity 14 with a force equal to or greater than a predetermined force, a connection state between the connector 101 and the mating connector 102 is not released with the protrusions 361 of the contacts 3A engaging with the protrusions 321 of the contacts 3. That is, the protrusions 321 of the contacts 3 and the protrusions 361 of the contacts 3A constitute a lock mechanism that allows the connection state between the connector 101 and the mating connector 102 to be released by the force equal to or greater than the predetermined force.

The falling piece 33 has a plate shape elongated in the thickness direction of the housing 1 (the fore-and-aft direction). A first end (front end) of the falling piece 33 is curved in the shape of an inverted U, and formed integrally with a second end (front end) of the rising piece 32.

The terminal piece 34 has a plate shape elongated in the widthwise direction of the housing 1 (the vertical direction). The terminal piece 34 is formed integrally with a second end (back end) of the falling piece 33. A tip of the terminal piece 34 is exposed from the housing 1 on one end side of the housing 1 in the thickness direction thereof (a back side). The terminal piece 34 has a surface (back surface) that serves as, for example a joined surface to be soldered onto a substrate.

Thus, in the present embodiment, each of the contacts 3 and the power terminals 4 possesses the spring piece 31, the rising piece 32, the falling piece 33 and the terminal piece 34. In the present embodiment, as seen along the lengthwise direction of the housing 1 (the lateral direction), each cross-sectional shape of the contacts 3 is the same as each cross-sectional shape of the power terminals 4. In other words, as seen along the arrangement direction (the lateral direction), each cross-section of the power terminals 4 is the same as each cross-section of the contacts 3. Herein, "the same" includes "almost the same". Therefore, a slightly difference in each cross-section of the contacts 3 and each cross-section of the power terminals 4 caused by manufacturing error or variation is an error within an allowable range.

As stated above, each of the contacts 3 serves as a terminal for signal transmission and each of the power terminals 4 serves as a terminal for power supply. Accordingly, a current larger than a current flowing through each contact 3 flows through each power terminal 4. Therefore, in the present embodiment, each width of the power terminals 4 (each dimension thereof in the lengthwise direction of the housing 1 (the lateral direction)) is larger than each width of the contacts 3, thereby making respective impedance of the power terminals 4 smaller than respective impedance of the contacts 3.

Each of the contacts 3 and the pair of power terminals 4 is housed in its own storage section 15, and in this state part thereof is exposed in the mating cavity 14. Specifically, each part of the spring pieces 31 of the contacts 3 and the power terminals 4 is exposed in the mating cavity 14 from an inside of the base 13. In addition, each part of the rising pieces 32 of the contacts 3 and the power terminals 4 is exposed in the mating cavity 14 from an inside of a corresponding first side wall 121.

Therefore, when the connector 101 is connected with the mating connector 102, each part of the contacts 3, exposed in the mating cavity 14 is in contact with a corresponding contact 3A of the mating connector 102. Thus, the contacts 3 of the connector 101 are electrically connected with the contacts 3A of the mating connector 102, respectively. In addition, each part of the pair of power terminals 4, exposed in the mating cavity 14 is in contact with a corresponding power terminal 4A to be described later of the mating connector 102. Thus, the pair of power terminals 4 of the connector 101 is electrically connected with a pair of power terminals 4A of the mating connector 102, respectively.

The connector 101 configured as described above is mounted on the substrate (hereinafter referred to as a "first substrate") built in an electronic device such as, for example a smartphone. The mating connector 102 to be described later corresponding to the connector 101 is mounted on another substrate (hereinafter referred to as a "second substrate") built in the same electronic device.

As shown in FIGS. 7 and 8, when the connector 101 is connected with the mating connector 102, first conductors formed on the first substrate are electrically connected with second conductors formed on the second substrate. Specifically, the contacts 3 of the connector 101 are electrically connected with the contacts 3A of the mating connector 102, and thereby the connector 101 is connected to the mating connector 102. In the present embodiment, the connector 101 and the mating connector 102 constitute a connection system 100. In other words, the connection system 100 includes the connector 101 and the mating connector 102.

The mating connector 102 corresponding to the connector 101 according to the present embodiment will be explained below with reference to FIGS. 7 to 13B. Note that FIGS. 7 and 8 illustrate the mating connector 102 with its front and back reversed. Therefore, the mating connector 102 will be explained hereinafter based on directions defined in FIGS. 9 to 13B.

In the present embodiment, the mating connector 102 is a header (a male connector), and includes a mating-side housing 1A, mating-side mounting metal fittings 2A, two or more (herein, thirty four) mating contacts 3A, and a pair of mating-side power terminals 4A. In the explanation below, the mating-side housing 1A and each mating-side mounting metal fitting 2A are simply referred to as a "housing 1A" and a "mounting metal fitting 2A" in principle, respectively. In addition, each mating contact 3A and each mating-side power terminal 4A are simply referred to as a "contact 3A" and a "power terminal 4A" in principle, respectively.

The housing 1A is formed of resin material that is electrically nonconductive and has a rectangular cuboid shape that is flat and elongated in the lateral direction. The housing 1A possesses a bottom wall 11A and a periphery wall 12A. The periphery wall 12A protrudes forward from a periphery of the bottom wall 11A, and has a rectangular frame shape in plan view. That is, the periphery wall 12A is formed to surround the periphery of the bottom wall 11A. Specifically, the periphery wall 12A is composed of a pair of first side walls 121A and a pair of second side walls 122A. The pair of first side walls 121A is a pair of walls of the periphery wall 12A along a lengthwise direction of the housing 1A. Part surrounded by the bottom wall 11A and the periphery wall 12A forms a mating cavity 14A that allows the connector 101 to be fit in. Specifically, the base 13 of the connector 101 is fit in the mating cavity 14A.

The housing 1A is insert molded along with the contacts 3A and a pair of mounting metal fittings 2A as inserted components. In other words, the pair of mounting metal fittings 2A is attached to the housing 1A. Half of the contacts 3A and the pair of power terminals 4A are integrally provided on an upper first side wall 121A. In addition, the remaining half of the contacts 3A and the pair of power terminals 4A are integrally provided on a lower first side wall 121A. In short, the housing 1A retains the contacts 3A and the pair of power terminals 4A aligned in an arrangement direction (the lateral direction). In other words, the pair of power terminals 4A is retained by the housing 1A.

Figure 13A:
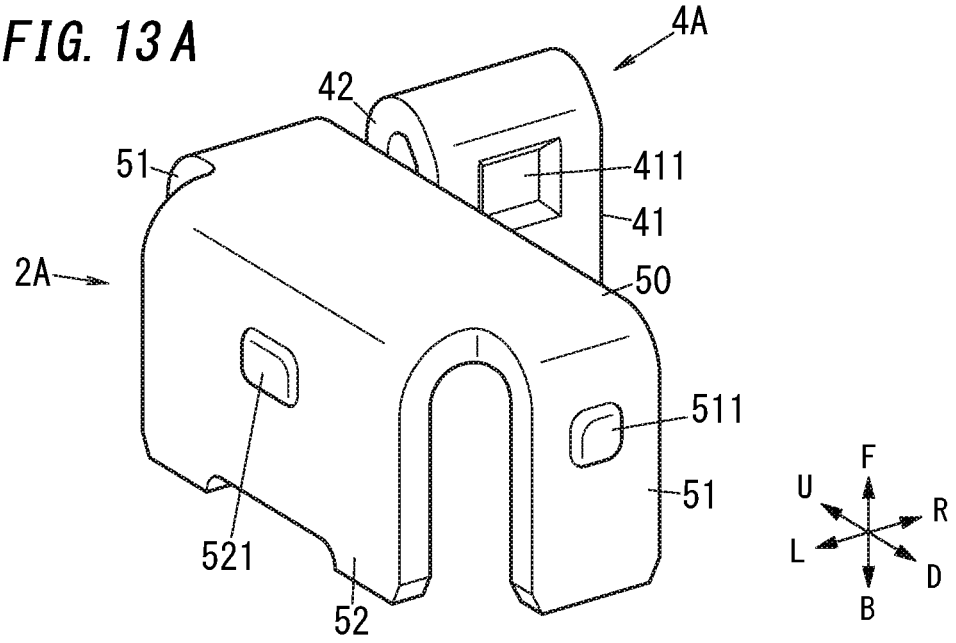
FIG. 13A is a perspective view of a mating-side mounting metal fitting and a mating-side power terminal in the connection system.
Figure 13B:
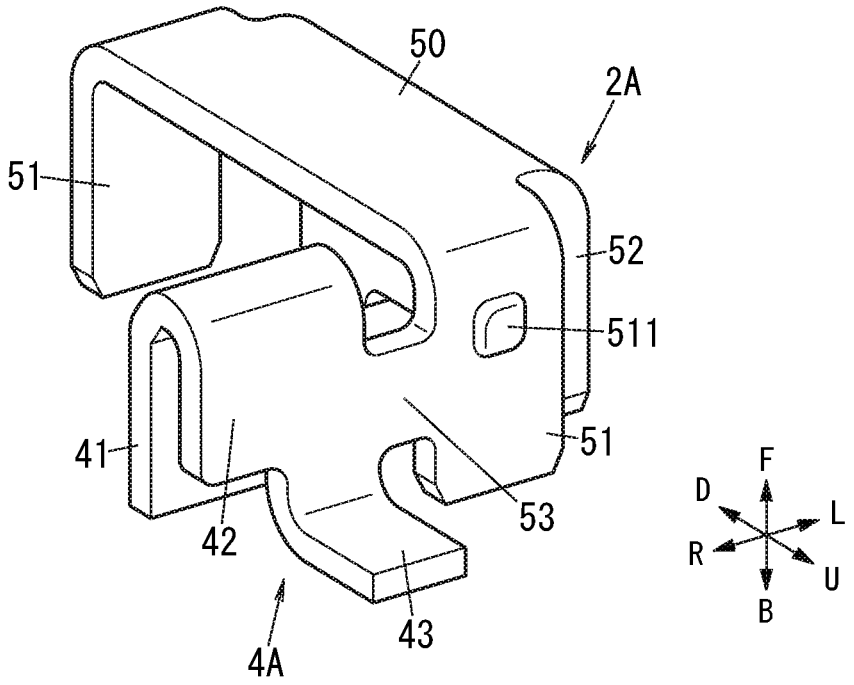
FIG. 13B is a perspective view of the mating-side mounting metal fitting and the mating-side power terminal in the connection system.
Figure 14A:
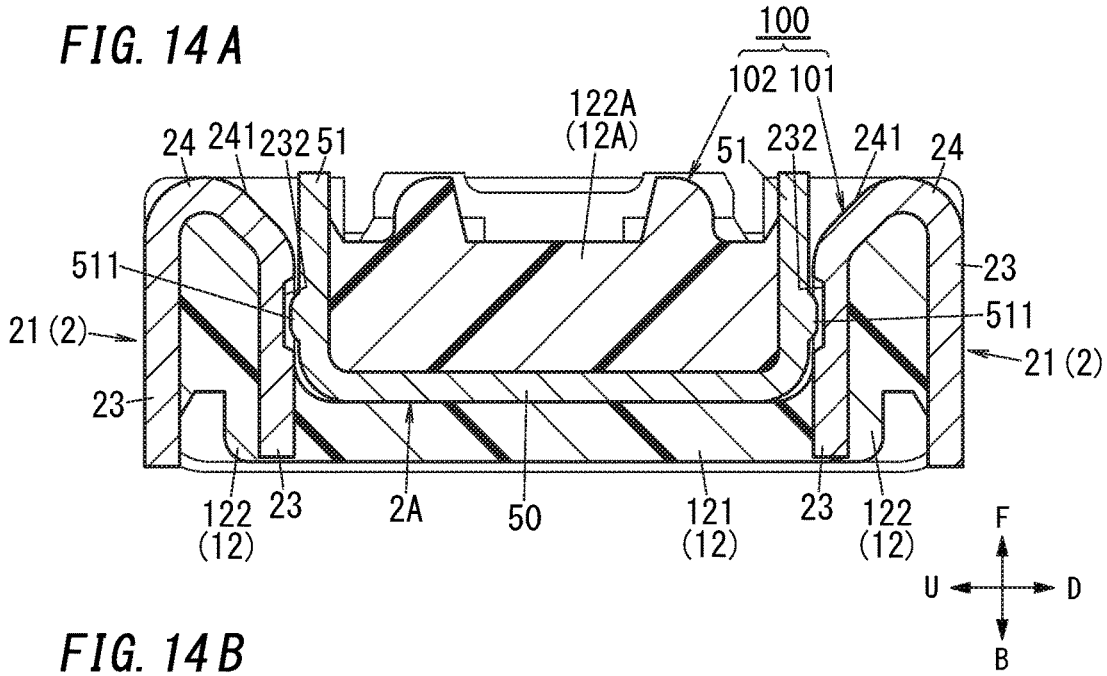
FIG. 14A is a sectional view of the connection system cut along a plane passing through a power terminal and the mating-side power terminal.
Figure 14B:
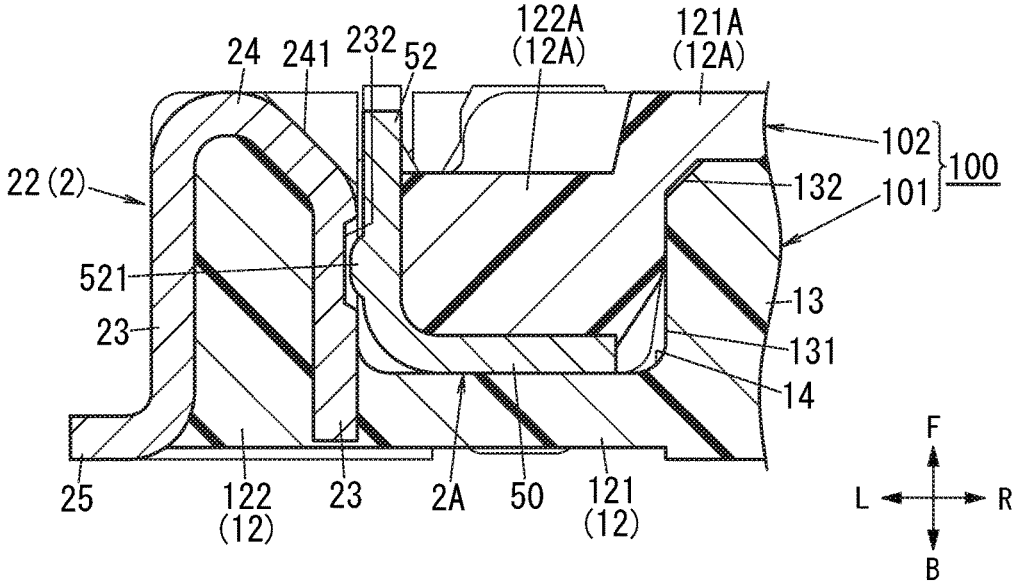
FIG. 14B is a sectional view of part of the connection system cut along a plane passing through the mounting metal fitting and the mating-side mounting metal fitting.

Each mounting metal fitting 2A is made of metal material such as, for example copper alloy, and possesses a main piece 50, a pair of first side pieces 51, and one second side piece 52 as shown in FIGS. 13A and 13B. Here, note that although a mounting metal fitting 2A, to be attached to one end (left end) of the housing 1A, of the pair of mounting metal fittings 2A will be explained as an example, another mounting metal fitting 2A to be attached to another end (right end) of the housing 1A also has a similar configuration thereto.

The main piece 50 has a plate shape elongated in a widthwise direction of the housing 1A (the vertical direction). Each of the pair of first side pieces 51 has a plate shape elongated in a thickness direction of the housing 1A (the fore-and-aft direction). A first side piece 51 that is one of the pair of first side pieces 51 (a lower one) is formed integrally with an end (a lower end), in a lengthwise direction, of the main piece 50, and a connection part therebetween is curved. In addition, a first side piece 51 that is another of the pair of first side pieces 51 (an upper one) is formed integrally with another end (an upper end), in the lengthwise direction, of the main piece 50, and a connection part therebetween is curved.

Each of the pair of first side pieces 51 is formed integrally with a protrusion 511 protruding along its own thickness direction (the vertical direction). The protrusion 511 is configured to, in a state where the connector 101 is connected with the mating connector 102, be fit in a concavity 232 to be described later of a corresponding first mounting sections 21 (see FIG. 14A). That is, the concavities 232 of the first mounting sections 21 and the protrusions 511 of the mounting metal fitting 2A constitute a lock mechanism that allows the connection state between the connector 101 and the mating connector 102 to be released by a force equal to or greater than a predetermined force.

The second side piece 52 has a plate shape elongated in the widthwise direction of the housing 1A (the vertical direction). The second side piece 52 is formed integrally with an end, in a widthwise direction (the lateral direction), of the main piece 50, and part therebetween is curved. The second side piece 52 is also formed integrally with a protrusion 521 protruding along a thickness direction of the second side piece 52 (the lateral direction). The protrusion 521 is configured to, in the state where the connector 101 is connected with the mating connector 102, be fit in a concavity 232 to be described later of the second mounting section 22 (see FIG. 14B). That is, the concavity 232 of the second mounting section 22 and the protrusion 521 of the mounting metal fitting 2A constitute a lock mechanism that allows the connection state between the connector 101 and the mating connector 102 to be released by a force equal to or greater than a predetermined force.

Each of the contacts 3A is a terminal for signal transmission. Each of the power terminals 4A is a terminal to be electrically connected with the power supply. Each of the contacts 3A and the power terminals 4A is formed by bending a strip metal plate. The contacts 3A are also gold-plated. As shown in FIGS. 7 and 8, each of the contacts 3A possesses a contact piece 35, a hanging piece 36 and a terminal piece 37 that are formed integrally. The contact piece 35 has a plate shape elongated in the thickness direction of the housing 1A (the fore-and-aft direction). The contact piece 35 is disposed on a surface of the periphery wall 12A, facing the mating cavity 14A. The contact piece 35 is configured to, in a state where the contacts 3 of the connector 101 are inserted into the mating cavity 14A, be in contact with a corresponding contact 3 of the connector 101.

The contact piece 35 is provided with a hollow 351 that is curved in toward a direction apart from the mating cavity 14A. The hollow 351 is configured to, in the state where the contacts 3 of the connector 101 are inserted into the mating cavity 14A, allow part of the corresponding contact 3 of the connector 101 to be fit in. That is, the contacts 3 of the connector 101 and the hollows 351 of the contact pieces 35 constitute a lock mechanism that allows the connection state between the connector 101 and the mating connector 102 to be released by a force equal to or greater than a predetermined force.

The hanging piece 36 has a plate shape elongated in the thickness direction of the housing 1A (the fore-and-aft direction). The hanging piece 36 is arranged along an outer surface (an upper surface or a lower surface) of a corresponding first side wall 121A. One end (front end) of the hanging piece 36 is curved in the shape of an inverted U, and formed integrally with a first end (front end) of the contact piece 35. The hanging piece 36 is formed integrally with the protrusion 361 protruding along a thickness direction of the hanging piece 36 (the vertical direction). The protrusions 361 engage with respective protrusions 321 of the contacts 3, which thereby constitute the lock mechanism stated above.

The terminal piece 37 has a plate shape elongated in the widthwise direction of the housing 1A (the vertical direction). A first end of the terminal piece 37 is formed integrally with a second end (back end) of the contact piece 35. A second end of the terminal piece 37 is exposed from the housing 1A on one end side of the housing 1A in the thickness direction thereof (the back side). One surface (front surface) of the terminal piece 37 serves as, for example a joined surface to be soldered onto a substrate.

As shown in FIGS. 13A and 13B, the power terminal 4A possesses a contact piece 41, a hanging piece 42 and a terminal piece 43 that are formed integrally. The contact piece 41, the hanging piece 42 and the terminal piece 43 possess similar functions to the contact piece 35, the hanging pieces 36 and the terminal pieces 37 of each contact 3A, respectively. However, the hanging piece 42 of the power terminal 4A is provided with no protrusion corresponding to the protrusions 361. In addition, one end (lower end) of the terminal piece 43 of the power terminal 4A is formed integrally with one end (back end) of not the contact piece 41 but the hanging piece 42.

Here, the mounting metal fitting 2A is formed integrally with the power terminal 4A as shown in FIGS. 13A and 13B. Specifically, the hanging piece 42 of the power terminal 4A is formed integrally with a first side piece 51 that is one (an upper one) of the pair of first side pieces 51 in the mounting metal fitting 2A, via a connection piece 53. In the state where the connector 101 is connected with the mating connector 102, the mounting metal fitting 2A is in contact with a corresponding mounting metal fitting 2. In other words, in a state where the contacts 3 are electrically connected with the contacts 3A, the mounting metal fitting 2 is attached to the housing 1 to be in contact with the corresponding mounting metal fitting 2A. In addition, in the state where the connector 101 is electrically connected with the mating connector 102, the power terminal 4A is in contact with a corresponding power terminal 4. In other words, in the state where the contacts 3 are electrically connected with the contacts 3A, the power terminal 4 is retained by the housing 1 to be in contact with the corresponding power terminal 4A.

(3) Mounting Metal Fitting

The mounting metal fittings 2 according to the present embodiment will be explained in detail with reference to FIGS. 1A to 2B below. In the explanation below, although a mounting metal fitting 2 of the pair of mounting metal fittings 2, to be attached to one end (the left end) of the housing 1 in the lengthwise direction thereof will be explained as an example, another mounting metal fitting 2 to be attached to another end (the right end) of the housing 1 in the lengthwise direction also has a similar configuration thereto. The mounting metal fitting 2 is made of metal material such as, for example copper alloy, and possesses, as the mounting members 20 to be attached to the housing 1, two first mounting sections 21 and one second mounting section 22. In the present embodiment, the first mounting sections 21 and the second mounting section 22 are made of the same material. In the present embodiment, the first mounting sections 21 and the second mounting section 22 also have the same thickness. When the two first mounting sections 21 are distinguished from each other in the explanation below, a first mounting section 21 that is one of the two first mounting sections 21 is referred to as a "first mounting section 21A", while another first mounting section 21 is referred to as a "first mounting section 21B".

The first mounting section 21A is attached to a place which is one end, in a lengthwise direction (the lateral direction), of a first side wall 121 that is one (a lower one) of the pair of first side walls 121, and where neither the contacts 3 nor the pair of power terminals 4 is arranged. The first mounting section 21B is attached to a place which is one end, in a lengthwise direction, of a first side wall 121 that is one (an upper one) of the pair of first side walls 121, and where neither the contacts 3 nor the pair of power terminals 4 is arranged. That is, each first mounting section 21 covers at least part of a region, in which no contacts 3 are arranged, of a corresponding first side wall 121 of the pair of first side walls 121.

The second mounting section 22 is attached to a second side wall 122 that is one (a left one) of the pair of second side walls 122. That is, the second mounting section 22 covers at least part of a second side wall 122 that is one (the left one) of the pair of second side walls 122. The second mounting section 22 is not formed integrally with any of the first mounting sections 21A and 21B. That is, the second mounting section 22 is separated from each of the two first mounting sections 21.

Each of the first mounting sections 21 and the second mounting section 22 possesses the pair of retention pieces 23. Each of the pair of retention pieces 23 has a plate shape elongated in the thickness direction of the housing 1 (the fore-and-aft direction). In the first mounting section 21A, the pair of retention pieces 23 faces each other in a thickness direction thereof (the vertical direction), and is configured to pinch the lower first side wall 121 in a thickness direction of the lower first side wall 121 (the vertical direction). In the first mounting section 21B, the pair of retention pieces 23 faces each other in a thickness direction thereof (the vertical direction), and is configured to pinch the upper first side wall 121 in a thickness direction of the upper first side wall 121. In the second mounting section 22, the pair of retention pieces 23 faces each other in a thickness direction thereof (the lateral direction), and is configured to pinch a left second side wall 122 in a thickness direction of the left second side wall 122 (the lateral direction). That is, each pair of retention pieces 23 is configured to pinch the periphery wall 12 in a thickness direction of the periphery wall 12.

Respective one ends, in a lengthwise direction, of each pair of retention pieces 23 are connected through an inverted U-shaped connection piece 24. That is, each of the first mounting sections 21 and the second mounting section 22 possesses its own connection piece 24 that connects its own pair of retention pieces 23. In a state where the mounting members 20 are attached to the housing 1, the connection pieces 24 straddle front ends of the first side walls 121 and also a front end of the second side wall 122.

Figure 3:
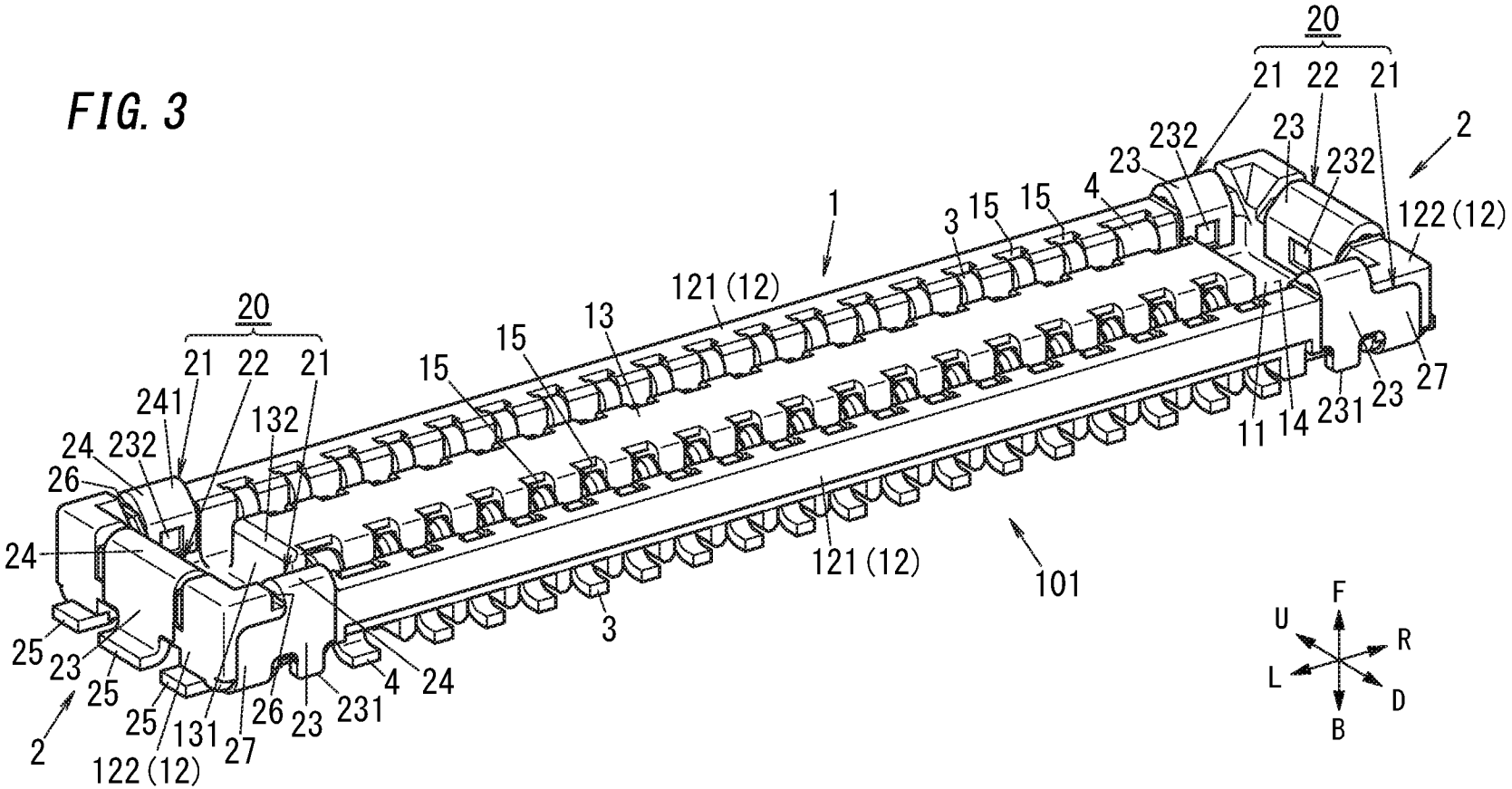
FIG. 3 is a perspective view of a connector in accordance with an embodiment of the present invention.
Figure 4:
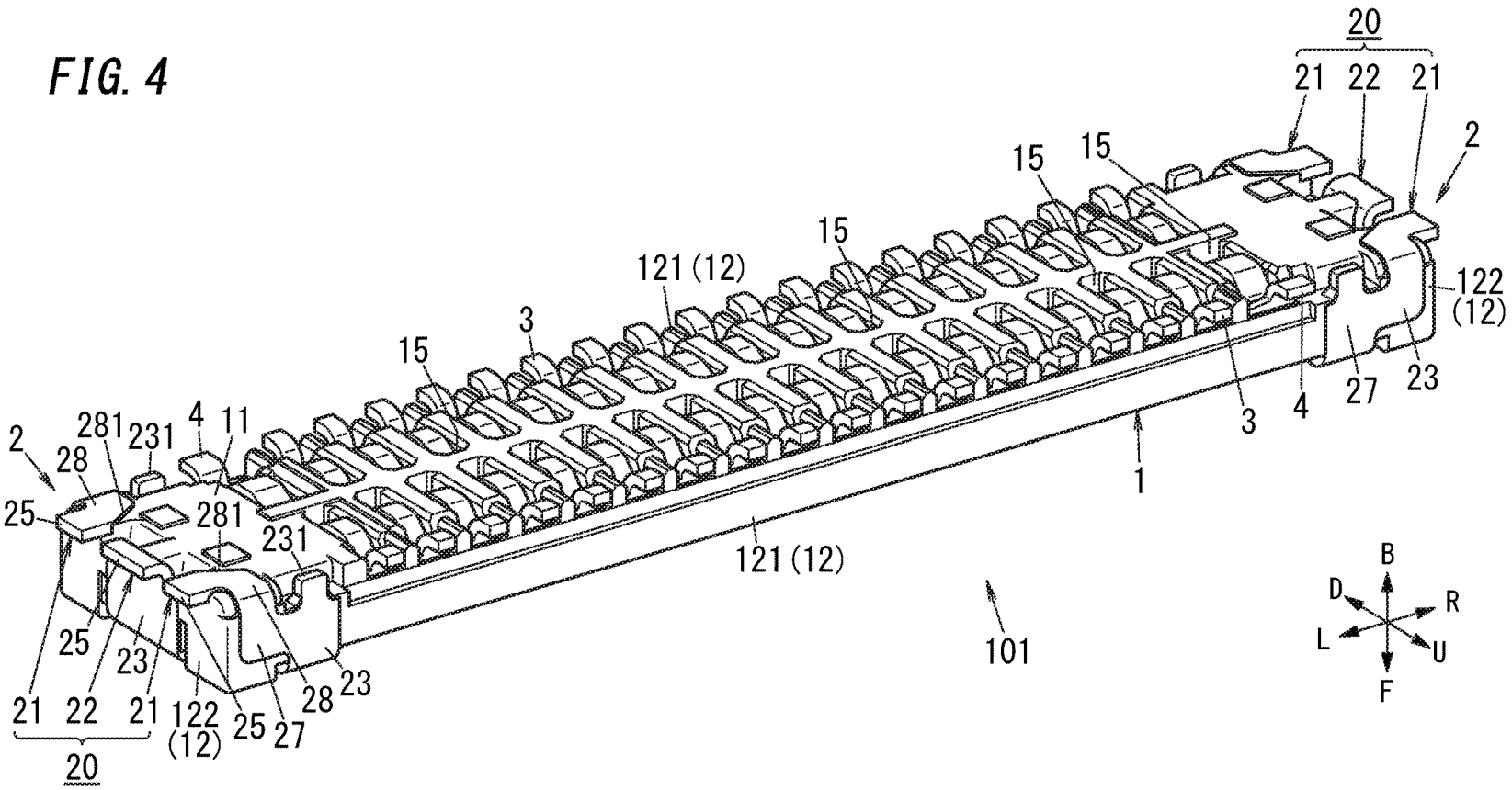
FIG. 4 is a perspective view of the connector with its front and back reversed.
Figure 5:
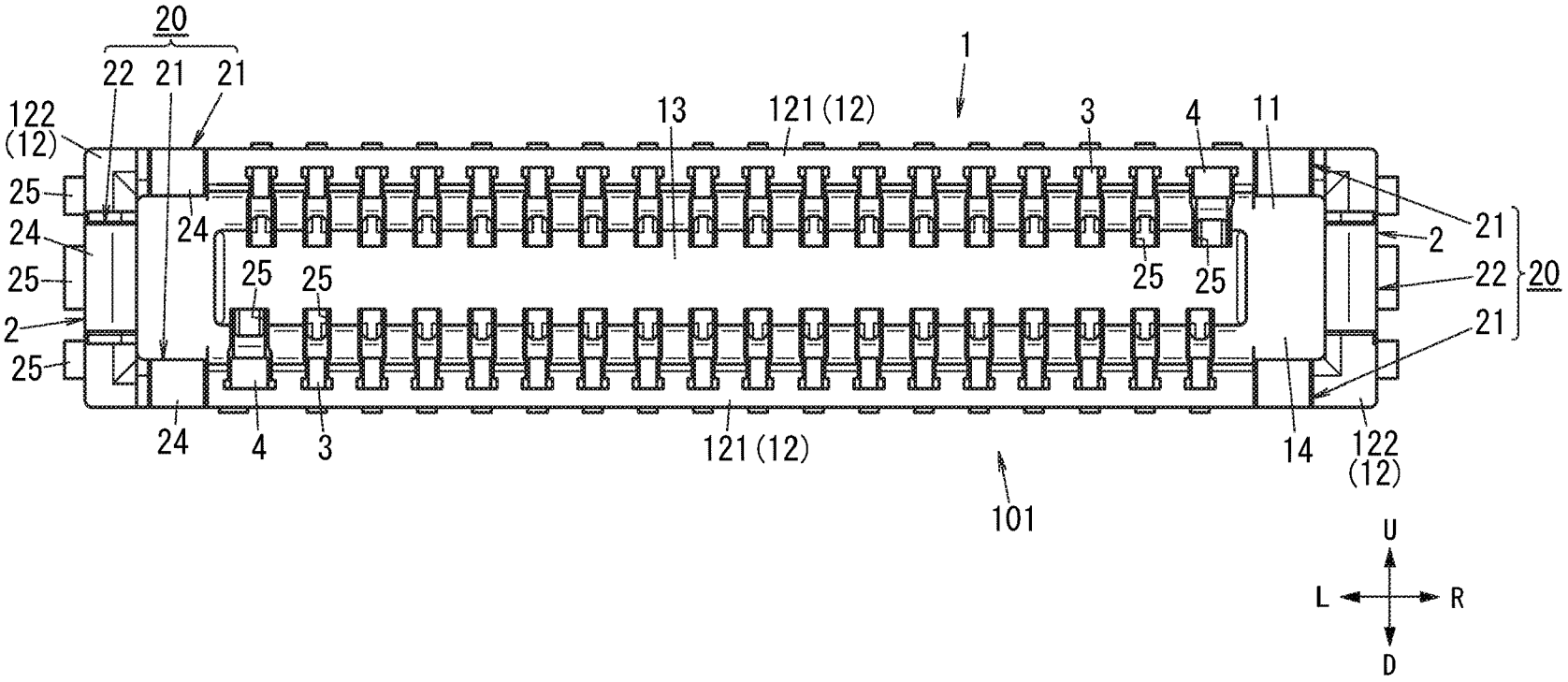
FIG. 5 is a front view of the connector.
Figure 6:
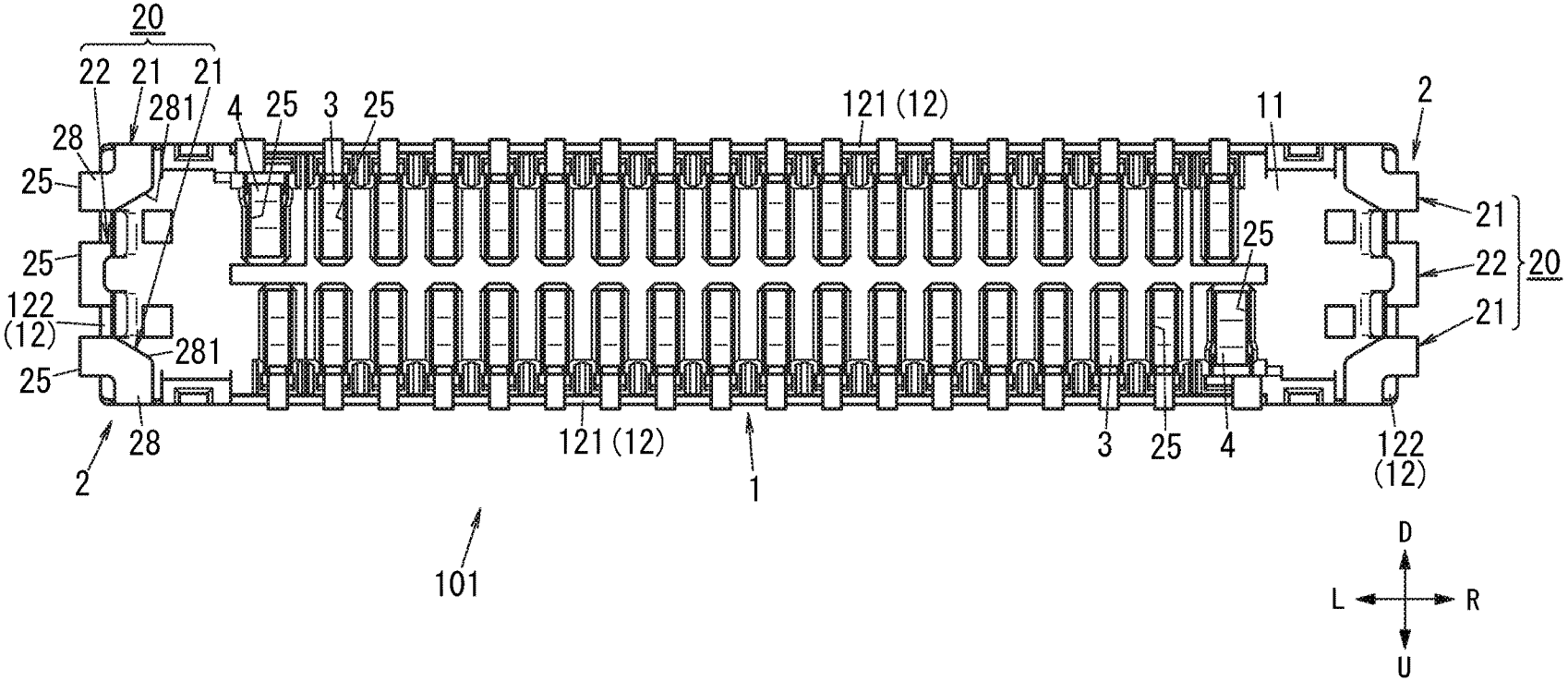
FIG. 6 is a back view of the connector.

In the state where the mounting members 20 are attached to the housing 1, a gap is formed between each front end of the first side walls 121 (or the front end of the second side wall 122) and a corresponding connection piece 24 (see FIG. 3). That is, in the state where the mounting members 20 are attached to the housing 1, each first mounting section 21 forms a void 26 as a gap that is formed between its own connection piece 24 and the housing 1.

Each connection piece 24 possesses an inclined section 241. The inclined section 241 is inclined diagonally backward from a top of a corresponding connection piece 24. In other words, in the state where the mounting members 20 are attached to the housing 1, each inclined section 241 is inclined relative to the bottom wall 11 so as to approach the bottom wall 11 toward the inside retention piece 23 from the outside retention piece 23 of a corresponding pair of retention pieces 23.

In each first mounting section 21, a back end of the outside retention piece 23 of the pair of retention pieces 23 possesses a joined face 231. In other words, the joined face 231 is provided for an end, on a side of the bottom wall 11, of a retention piece 23 that is at least one of the pair of retention pieces 23 in at least one of the first mounting sections 21 and the second mounting section 22. In a state where the contacts 3 are joined on a substrate, for example, the joined face 231 is soldered on the substrate. Each width (each dimension in the lateral direction) of the back ends of the outside retention pieces 23 is smaller than width of part, other than the back end, of a corresponding outside retention piece 23. That is, width of each end at the side of the bottom wall 11 in a direction crossing a direction in which each pair of retention pieces 23 is arranged (here, the lateral direction) is smaller than width of part, other than the end, at the side of the bottom wall 11, of a corresponding one of each pair of retention pieces 23.

In each first mounting section 21, the outside retention piece 23 of the pair of retention pieces 23 is formed integrally with a corresponding extension piece 27. The extension piece 27 is extended leftward from a left end edge of the outside retention piece 23, and has a plate shape elongated in the lengthwise direction of the housing 1 (the lateral direction). That is, at least one of the pair of retention pieces 23 in each first mounting section 21 possesses the extension piece 27 extended in the arrangement direction. Each extension piece 27 is formed integrally with a bottom piece 28 on a left side of its own back end edge. The bottom piece 28 is curved from the back end edge of a corresponding extension piece 27 to be extended toward an inside of the housing 1 along the bottom wall 11. That is, each first mounting section 21 possesses the bottom piece 28 that is connected to a corresponding extension piece 27 and extended along the bottom wall 11.

In each first mounting section 21, one end edge (left end edge) of the bottom piece 28 is formed integrally with a joined section 25. The joined section 25 protrudes from one end edge of a corresponding bottom piece 28 in the lengthwise direction of the housing 1 (the lateral direction) to be exposed outside the housing 1. In the state where the contacts 3 are joined on the substrate, each joined section 25 is joined to a substrate. The second mounting section 22 also possesses a joined section 25 like the first mounting sections 21. The joined section 25 of the second mounting section 22 is curved from a back end edge of a corresponding outside retention piece 23 and is extended along the bottom wall 11 to be exposed outside the housing 1. Thus, each of the first mounting sections 21 and the second mounting section 22 possesses its own joined section 25 to be joined to the substrate. Each joined section 25 protrudes from the periphery wall 12 in the arrangement direction.

In the second mounting section 22, width of the joined section 25 (dimension in the vertical direction) is smaller than width of part, other than the joined section 25, of the outside retention piece 23. That is, the width of the joined section 25 in a direction crossing the arrangement direction (here, the vertical direction) is smaller than width of part, other than the joined section 25, of the second mounting section 22.

Each bottom piece 28 is provided with a taper 281. The taper 281 is provided to cut a corner of the bottom piece 28, in which no extension piece 27 and joined section 25 are connected, into a triangular shape. That is, the bottom piece 28 connects the extension piece 27 and joined section 25. In addition, the taper 281 is provided for part, other than a region in which the extension piece 27 and joined section 25 are connected, of the bottom piece 28.

Here, an inside retention piece 23 of each pair of retention pieces 23 is provide with the concavity 232 that is curved in toward a direction apart from the mating cavity 14. The protrusions 511 of the mounting metal fittings 2A are fit in the concavities 232 of the first mounting sections 21, which thereby constitute the lock mechanism stated above. In addition, the protrusions 521 of the mounting metal fittings 2A are fit in the concavities 232 of the second mounting sections 22, which thereby constitute the lock mechanism stated above.

(4) Advantage

Advantage of the mounting metal fitting 2 according to the present embodiment will be explained comparing with a mounting metal fitting as a comparison example. The mounting metal fitting as the comparison example possesses two first mounting sections and one second mounting section, like the mounting metal fitting 2 according to the present embodiment. In the mounting metal fitting as the comparison example, the two first mounting sections and the one second mounting section are formed integrally. That is, in the mounting metal fitting as the comparison example, the two first mounting sections are not separated from the one second mounting section.

Here, when a connector is connected with a mating connector in a misaligned state, or when external stress is exerted on the connector or the mating connector after the connection thereof, the stress may be exerted on the mounting metal fitting. Specifically, stress may be exerted on each first mounting section along the arrangement direction (the lateral direction). Also, stress may be exerted on the second mounting section along a direction crossing the arrangement direction (the vertical direction). When such stress is exerted on the mounting metal fitting, the mounting metal fitting may be plastically deformed. That is, there is a possibility that stress will be exerted on the housing by the plastic deformation of the mounting metal fitting. In this case, if the housing is made from, for example resin, the housing is possibly deformed by receiving the stress.

A connector with the mounting metal fitting as the comparison example has a possibility that in case stress is exerted on one of the first mounting sections and the second mounting section, the stress is transmitted to the other, thereby plastically deforming the first mounting sections and the second mounting section. This is because the first mounting sections and the second mounting section are formed integrally. In this case, the housing is susceptible to stress, which may result in reduction of housing strength.

In contrast, in the mounting metal fitting 2 according to the present embodiment, the first mounting sections 21 are separated from the second mounting section 22. Accordingly, in the present embodiment, even in case stress is exerted on one of the first mounting sections 21 and the second mounting section 22, the stress is hardly transmitted to the other. Specifically, in the mounting metal fitting 2 according to the present embodiment, in case stress is exerted on one of the first mounting sections 21 and the second mounting section 22, one mounting section is just plastically deformed and the other mounting sections are hard to be plastically deformed. Therefore, the mounting metal fitting 2 according to the present embodiment is harder to plastically deform than the mounting metal fitting as the comparison example and the housing 1 is less susceptible to the stress. It is consequently possible to improve the strength of the housing 1.

In addition, when the housing 1 is insert molded along with the mounting metal fittings 2 as inserted components, the mounting metal fitting 2 according to the present embodiment has the advantage of easier dimensional adjustment than the mounting metal fitting as the comparison example. Specifically, inserting the mounting metal fittings 2 into a mold for insert molding may require dimensional adjustment of one of the first mounting sections 21 and the second mounting section 22 for insertion into the mold. Here, in the case of the mounting metal fitting as the comparison example, since the first mounting sections and the second mounting section are formed integrally, one of the first mounting sections and the second mounting section is deformed for dimensional adjustment, and stress by the deformation is then transmitted to the other, so that the other may be deformed. Thus, the mounting metal fitting as the comparison example makes it difficult to perform the dimensional adjustment.

In contrast, in the mounting metal fitting according to the present embodiment, since the first mounting sections 21 are separated from the second mounting section 22, even if one of the first mounting sections 21 and the second mounting section 22 is deformed for dimensional adjustment, stress by the deformation is hardly transmitted to the other, so that the other is hard to deform. Thus, the mounting metal fitting 2 according to the present embodiment makes it easier to perform the dimensional adjustment than the mounting metal fitting as the comparison example.

That is, it is possible to stably produce connectors 101 including the mounting metal fitting 2 according to the present embodiment to improve the productivity as compared with connectors including the mounting metal fitting as the comparison example.

(Modified Example)

Preferably, the first mounting sections 21 and the second mounting section 22 are made of the same material such as, for example copper alloy like the present embodiment. In addition, the first mounting sections 21 and the second mounting section 22 preferably have the same thickness like the present embodiment. Any of the configurations described above enables the first mounting sections 21 and the second mounting section 22 to have the same coefficient of linear expansion. In addition, any of the configurations enables equalizing heat transmitted to the first mounting sections 21 and the second mounting section 22 in a reflow soldering process. Therefore, any of the configurations enables the mounting metal fittings 2 to be hard to deform and warp in the reflow soldering process.

The first mounting sections 21 and the second mounting section 22 being made of the same material enables reduction in material cost and parts count because the first mounting sections 21 and the second mounting section 22 can be produced from the same carrier.

Respective materials of the first mounting sections 21 and the second mounting section 22 may be different from each other. Respective thicknesses of the first mounting sections 21 and the second mounting section 22 may also be different from each other.

In the present embodiment, the connection pieces 24 are curved in the shape of an inverted U, but not intended to limit thereto. For example, respective back end sides of the connection pieces 24 may be opened in the shape of a square bracket.

In the present embodiment, each of the mounting metal fittings 2 is composed of two first mounting sections 21 and one second mounting section 22, but not intended to limit thereto. For example, each of the mounting metal fittings 2 may be composed of one first mounting section 21 and one second mounting section 22. Besides, in each of the mounting metal fittings 2, only one of the two first mounting sections 21 may be separated from the second mounting section 22, and another first mounting section 21 may be formed integrally with the second mounting section 22.

In the present embodiment, the mounting metal fittings 2 possess the concavities 232 and the mating-side mounting metal fittings 2A possess the protrusions 511 and 521, but the present embodiment is not intended to limit thereto. That is, the mounting metal fittings 2 and the mating-side mounting metal fittings 2A needn't possess the concavities 232 and the protrusions 511 and 521, respectively. In other words, the connection system 100 may possess no lock mechanism. In case the connection system 100 possesses lock mechanisms, it is possible to improve connection strength between the connector 101 and the mating connector 102.

In the present embodiment, the connector 101 is a socket, but not intended to limit thereto. For example, the connector 101 may be a header. That is, the connector 101 to which the mounting metal fittings 2 are attached is preferably a connector that, when a socket and a header are connected to each other, is one of them whose periphery wall 12 (or periphery wall 12A) is positioned outside. This is because the periphery wall 12 is an outermost wall of the connector 101, and therefore easy to receive force from inside to outside caused by deviation from a regular position of the mating connector 102 relative to the connector 101. In addition, the periphery wall 12 easily receives force from outside to inside caused by contact with another thing different from the connector 101 and the mating connector 102, such as another substrate or a tool.

As stated above, a mounting metal fitting (2) according to a first aspect includes mounting members (20) to be attached to a housing (1) of a connector (101). The housing (1) possesses a bottom wall (11) and a periphery wall (12) surrounding a periphery of the bottom wall (11). The periphery wall (12) is composed of a pair of first side walls (121) and a pair of second side walls (122). The pair of first side walls (121) retains contacts (3) with the contacts (3) aligned in an arrangement direction. One of the pair of second side walls (122) connects one ends of the pair of first side walls (121), while another of the pair of second side walls (122)

connects other ends of the pair of first side walls (121). The mounting members (20) possess a first mounting section (21) and a second mounting section (22). The first mounting section (21) covers at least part of a region, in which no contacts (3) are aligned, of a first side wall (121) that is one of the pair of first side walls (121). The second mounting section (22) is separated from the first mounting section (21), and covers at least part of a second side wall (122) that is at least one of the pair of second side walls (122).

This configuration enables improvement in the strength of the housing (1) because even if stress is exerted on one of the first mounting section (21) and the second mounting section (22), the stress is hardly transmitted to the other, so that the mounting metal fitting (2) is hard to plastically deform and the housing (1) is less susceptible to the stress.

In a second aspect according to the first aspect, at least one of the first mounting section (21) and the second mounting section in the mounting metal fitting (2) further possesses a joined section (25) to be joined to a substrate.

With this configuration, it is possible to solder the joined section (25) to the substrate in order to join the mounting metal fitting (2) to the substrate. The configuration accordingly enables improvement in the strength of the mounting metal fitting (2) as compared to the configuration provided with no joined section (25), thereby further improving the strength of the housing (1). In the present embodiment, each of the first mounting sections (21) and the second mounting section (22) possesses the joined section (25), but only one of the first mounting sections (21) and the second mounting section (22) may possess the joined section (25). Alternatively, the first mounting sections (21) and the second mounting section (22) may possess no joined section (25).

In a third aspect according to the second aspect, the second mounting section (22) of the mounting metal fitting (2) possesses the joined section (25). In a direction crossing the arrangement direction, width of the joined section (25) is smaller than width of part, other than the joined section (25), of the second mounting section (22).

This configuration makes it easy to stick solder on the joined portion (25). Thus, with this configuration, when the joined section (25) is soldered to a substrate, a solder bridge is not likely to occur between the joined portion (25) and another joined portion (25).

The configuration also enables improvement in self-alignment effect when the mounting metal fitting (2) is soldered to a substrate. That is, it is possible to improve mounting precision because while the solder is melting, the solder is pulled by surface tension and thereby the joined portion (25) comes close to a tip of a conductor of the substrate even if the joined portion (25) is disposed on the conductor in a misaligned state. Note that this configuration is not indispensable. That is, the width of the joined portion (25) needn't equal the width of the part, other than the joined section (25), of the second mounting section (22).

In a fourth aspect according to the second aspect or the third aspect, the joined section (25) of the mounting metal fitting (2) protrudes from the periphery wall (12) along the arrangement direction.

The configuration enables improvement in self-alignment effect when the mounting metal fitting (2) is mounted on a substrate. Here, when the contacts (3) are mounted on the substrate by soldering, sufficient self-alignment effect is obtained in the arrangement direction of the contacts (3) (the lateral direction), but is hardly obtained in a protrusion direction of the contacts (3) (the vertical direction). That is, the self-alignment effect by soldering the contacts (3) to the substrate is hardly obtained in a widthwise direction of the connector (101) (the vertical direction).

Therefore, in the configuration, the joined section (25) protrudes in the arrangement direction of the contacts (3), thereby increasing the self-alignment effect when the joined section (25) is mounted on a substrate. That is, the configuration enables improvement in the self-alignment effect in the arrangement direction of the joined section (25) (the vertical direction), namely the widthwise direction of the connector (101) when the joined section (25) is mounted on the substrate by soldering.

With the configuration, in case both the first mounting section (21) and the second mounting section (22) have their respective joined sections (25), it is possible to cut the joined sections (25) from the carrier in a limp in one process because respective tips of the joined sections (25) are easy to align. The configuration therefore makes it possible to simplify production process of the mounting metal fittings (2), stably produce the mounting metal fittings (2) with small dimensional tolerance and improve the productivity. Note that the configuration is not indispensable. That is, the joined sections (25) needn't protrude from the periphery wall (12) along an arrangement direction of the joined sections (25).

In a fifth aspect according to any of the first to fourth aspects, at least one of the first mounting section (21) and the second mounting section (22) in the mounting metal fitting (2) possesses a pair of retention pieces (23) and a connection piece (24). The pair of retention pieces (23) pinches the periphery wall (12) in a thickness direction of the periphery wall (12). The connection piece (24) connects one ends of the pair of retention pieces (23).

With the configuration, for example, if the first mounting section (21) possesses the pair of retention pieces (23) and the connection piece (24), the first mounting section (21) may receive stress from at least three directions of forward, right and left. Alternatively, for example, if the second mounting section (22) possesses the pair of retention pieces (23) and the connection piece (24), the second mounting section (22) may receive stress from at least three directions of forward, upward and downward. The configuration therefore enables further improvement in the strength of the housing (1) because the mounting metal fitting (2) is easy to receive to stress, while the housing (1) is less susceptible to the stress. Note that the configuration is not indispensable. For example, each of the first mounting section (21) and the second mounting section (22) may be configured to receive stress from one direction or two directions.

In a sixth aspect according to the fifth aspect, at least one of the first mounting section (21) and the second mounting section (22) in the mounting metal fitting (2) possesses a void (26) as a gap formed between the connection piece (24) and the housing (1) in a state where the mounting members (20) are attached to the housing (1).

With the configuration, the mounting metal fitting (2), especially the connection piece (24) has a margin for elastic deformation, and therefore is hard to plastically deform. The configuration therefore enables further improvement in the strength of the housing (1) because the mounting metal fitting (2) is easy to receive stress, while the housing (1) is less susceptible to the stress. Note that the configuration is not indispensable. That is, the first mounting section (21) and second mounting section (22) may possess no void (26). The void (26) is easy to be formed when the mounting metal fitting (2) is attached to the housing (1) by press fitting.

In a seventh aspect according to the fifth aspect or the sixth aspect, the connection piece (24) of the mounting metal fitting (2) possesses an inclined section (241). The inclined section (241) is inclined relative to the bottom wall (11) so as to approach the bottom wall (11) toward an inside retention piece (23) from an outside retention piece (23) of the pair of retention pieces (23).

With this configuration, when the connector (101) is connected with a mating connector (102), the mating connector (102) is guided by the inclined section (241) even if the mating connector (102) is in a slight misalignment relative to the connector (101). The configuration therefore enables easy connection between the connector (101) and the mating connector (102). Note that the configuration is not indispensable. That is, the connection piece (24) may possess no inclined section (241).

In an eighth aspect according to any of the fifth to seventh aspects, in the mounting metal fitting (2), at least one of the pair of retention pieces (23) in the first mounting section (21) possesses an extension piece (27) extended in the arrangement direction.

With this configuration, in case at least one retention piece (23) with the extension piece (27) receives stress, not only the retention piece (23) but also the extension piece (27) is able to receive the stress. It is therefore possible to improve the strength of the retention piece (23). The configuration accordingly enables further improvement in the strength of the housing (1) because the mounting metal fitting (2) is hard to plastically deform, so that the housing (1) is hard to receive stress. Note that the configuration is not indispensable. That is, any of the pair of retention pieces (23) may be provided with no extension piece (27).

In a ninth aspect according to the eighth aspect, the mounting metal fitting (2) further possesses a bottom piece (28). The bottom piece (28) is connected to the extension piece (27) and extended along the bottom wall (11).

This configuration enables the mounting metal fitting (2) to receive respective stress not only from three directions through the pair of retention pieces (23) and the connection piece (24) but also four directions through further the bottom piece (28). The configuration therefore enables further improvement in the strength of the housing (1) because the mounting metal fitting (2) is easy to receive stress, while the housing (1) is less susceptible to the stress. Note that the configuration is not indispensable. That is, the mounting metal fitting (2) may possess no bottom piece (28).

In a tenth aspect according to the ninth aspect, the first mounting section (21) in the mounting metal fitting (2) further possesses a joined section (25) to be joined to a substrate. The bottom piece (28) connects the extension piece (27) and the joined section (25). Part, other than a region in which the extension piece (27) and the joined section (25) are connected, of the bottom piece (28) is provided with a taper (281).

This configuration makes it easy to, when the joined section (25) is soldered on the substrate, stick solder on the joined section (25) because the solder is hard to flow from the joined section (25) to the bottom piece (28). The configuration accordingly enables improvement in mounting precision of the joined section (25). Note that the configuration is not indispensable. That is, the bottom piece (28) may be provided with no taper (281).

In an eleventh aspect according to the fifth to ninth aspects, at least one of the pair of retention pieces (23) in the mounting metal fitting (2) is configured to, in a state where the contacts (3) joined to a substrate, be in contact with the substrate, at least when the connection piece (24) elastically deforms.

With this configuration, in case the mounting metal fitting (2) receives stress toward the substrate (backward stress), the pair of retention pieces (23) is in contact with the substrate, thereby enabling the substrate to also receive the stress. The configuration therefore enables further improvement in the strength of the housing (1) because the mounting metal fitting (2) is hard to plastically deform, while the housing (1) is less susceptible to stress. Note that the configuration is not indispensable. That is, the pair of retention pieces (23) may be out of contact with the substrate when the connection piece (24) elastically deforms.

In a twelfth aspect according to the fifth to eleventh aspects, in the mounting metal fitting (2), an end, on a side of the bottom wall (11), of a retention piece (23) that is at least one of the pair of retention pieces (23) in at least one of the first mounting section (21) and the second mounting section (22) possesses a joined face (231). The joined face (231) is joined to a substrate with the contacts (3) joined to the substrate.

This configuration allows the pair of retention pieces (23) to be joined to the substrate, and therefore stress exerted on the pair of retention pieces (23) is transmitted to the substrate, thereby enabling the substrate to also receive the stress. It is therefore possible to improve the strength of the pair of retention pieces (23). Note that this configuration is not indispensable. That is, any of the pair of retention pieces (23) of the first mounting section (21) and the pair of retention pieces (23) of the second mounting section (22) may be provided with no joined face (231).

In a thirteenth aspect according to the twelfth aspect, in the mounting metal fitting (2), the end, on the side of the bottom wall (11), of the retention pieces (23) that is at least one of the pair of retention pieces (23) in the second mounting section (22) possesses the joined face (231). In a direction crossing an arrangement direction of the pair of retention pieces (23), width of the end on the side of the bottom wall (11) in the second mounting section (22) is smaller than width of part, other than the end on the side of the bottom wall (11), of the pair of retention pieces (23).

This configuration makes it easy to stick solder on the joined face (231). Therefore, a solder bridge is not likely to occur between adjoining contacts (3). In addition, with the configuration, insulation distance is easy to secure between the end, on the side of the bottom wall (11), of the retention piece (23) and a neighboring contact (3). Note that the configuration is not dispensable. That is, the width of the end on the side of the bottom wall (11) may be equal to the width of the part, other than the end on the side of the bottom wall (11), of the retention piece (23).

A connector (101) according to a fourteenth aspect includes a mounting metal fitting (2) of any of the first to thirteenth aspects, the housing (1) to which the mounting metal fitting (2) is attached, and the contacts (3) retained by the pair of first side walls (121).

This configuration makes it possible to realize the connector (101) that is capable of improving the strength of the housing (1).

In a fifteenth aspect according to the fourteenth aspect, the connector (101) further possesses a power terminal (4). The power terminal (4) is retained by the housing (1) to be aligned along with the contacts (3) in the arrangement direction and is to be electrically connected to a power supply. The power terminal (4) is retained by the housing (1) in an order of the first mounting section (21), the power terminal (4) and the contacts (3).

With this configuration, the power terminal (4) is located at a position that is easy to receive the effect of improvement in the strength of the housing (1) by the mounting metal fitting (2). Therefore, the power terminal (4) is less susceptible to stress, thereby enabling improvement in the reliability of contact between the power terminal (4) and a conductor on the substrate. Note that this configuration is not dispensable. That is, the power terminal (4) needn't be disposed between the first mounting section (21) and the contacts (3).

In a sixteenth aspect according to the fifteenth aspect, the connector (101) includes, as the power terminal (4), a pair of power terminals (4). The pair of power terminals (4) is retained by the housing (1) so as to be, in plan view, invariant under a point reflection through a center of the housing (1).

With this configuration, the mounting metal fitting (2) is hard to receive biased stress as compared to the configuration two power terminals (4) are disposed on either side (an upper side or a lower side). Note that this configuration is not dispensable. That is, two power terminals (4) needn't be, in plan view, invariant under a point reflection through a center of the housing (1).

In a seventeenth aspect according to the fifteenth aspect or the sixteenth aspect, as seen along the arrangement direction, a cross-section of each of the pair of power terminals (4) in the connector (101) is the same as a cross-section of each of the contacts (3).

With this configuration, when the connector (101) is connected with the mating connector (102) with the connector (101) fixed, the mating connector (102) comes into contact with the power terminals (4) and the contacts (3) at almost the same time. The horizontal balance (balance in the fore-and-aft direction) of the mating connector (102) is unlikely to collapse. Therefore, with the configuration, the connector (101) is easy to be connected with the mating connector (102), while the mating connector (102) is hard to come off the connector (101). Note that this configuration is not dispensable. That is, each cross-section of the power terminals (4) may have a shape different from a cross-section of each of the contacts (3).

In an eighteenth aspect according to the fifteenth to seventeenth aspects, the contacts (3) in the connector (101) are configured to be electrically connected to mating contacts (3A) of a mating connector (3A). The mating connector (102) includes a mating-side housing (1A), a mating-side power terminal (4A) and a mating-side mounting metal fitting (2A). The mating-side power terminal (4A) is retained by the mating-side housing (1A) to be electrically connected to the power terminal (4). The mating-side mounting metal fitting (2A) is integrally formed with the mating-side power terminal (4A) and attached to the mating-side housing (1A). The mounting metal fitting (2) is attached to the housing (1) so as to be in contact with the mating-side mounting metal fitting (2A) in a state where the contacts (3) are electrically connected to the mating contacts (3A). The power terminal (4) is retained by the housing (1) so as to be in contact with the mating-side power terminal (4A) in the state where the contacts (3) are electrically connected to the mating contacts (3A).

With this configuration, the mounting metal fitting being electrically connected with the mating-side mounting metal fitting (2A) while securing the reliability of contact between the power terminal (4) and the mating-side power terminal (4A) enables reduction in conductor resistance of the power terminal (4). In addition, with this configuration, the mounting metal fitting (2) being in contact with the mating-side mounting metal fitting (2A) enables improvement in heat radiation effect of the mounting metal fitting (2). Note that this configuration is not dispensable. That is, the mating-side mounting metal fitting (2A) needn't be formed integrally with the mating-side power terminal (4A).

In a nineteenth aspect according to the fourteenth to eighteenth aspects, the housing (1) in the connector (101) is insert molded along with the mounting metal fitting (2) as an inserted component.

With this configuration, the mounting metal fitting (2) is easier to receive stress than the mounting metal fitting (2) that is attached to the housing (2) by press fitting. It is therefore possible to further improve the strength of the housing (1). Note that this configuration is not dispensable. That is, the mounting metal fitting (2) may be attached to the housing (2) by press fitting.

A connection system (100) according to a twentieth aspect possesses a connector (101) of any of the fourteenth to nineteenth aspects, and a mating connector (102). The mating connector (102) possesses mating contacts (3A) that are electrically connected to the contacts (3).

This configuration enables realization of the connection system (100) capable of improving the strength of the housing (1).

The mounting metal fitting 2, the connector 101 and the connection system 100, according to the present embodiment have been described above. Note that the embodiment describe above is merely one of various embodiments of the present invention. In the embodiment described above, various modifications may be made according to general arrangement and the like as long as the object of the present invention can be achieved.

REFERENCE SIGNS LIST

1 Housing
11 Bottom wall
12 Periphery wall
121 First side wall
122 Second side wall
1A Mating-side housing
2 Mounting metal fitting
20 Mounting members
21 First mounting section
22 Second mounting section
23 Retention piece
24 Connection piece
241 Inclined section
25 Joined section
26 Void
27 Extension piece
28 Bottom piece
281 Taper
2A Mating-side mounting metal fitting
3 Contact
3A Mating contact
4 Power terminal
4A Mating-side power terminal
100 Connection system
101 Connector
102 Mating connector

The invention claimed is:

1. A mounting metal fitting, comprising mounting members to be attached to a housing of a connector, the housing including a bottom wall and a periphery wall surrounding a periphery of the bottom wall, the periphery wall being composed of a pair of first side walls and a pair of second side walls, the pair of first side walls retaining contacts with the contacts aligned in an arrangement direction, one of the pair of second side walls connecting one ends of the pair of first side walls, while another of the pair of second side walls connecting other ends of the pair of first side walls, wherein the mounting members include a first mounting section and a second mounting section, the first mounting section covering at least part of a region, in which no contacts are aligned, of a first side wall that is one of the pair of first side walls, the second mounting section being separated from the first mounting section, the second mounting section covering at least part of a second side wall that is at least one of the pair of second side walls, wherein at least one of the first mounting section and the second mounting section includes a pair of retention pieces and a connection piece, the pair of retention pieces pinching the periphery wall in a thickness direction of the periphery wall, the connection piece connecting one ends of the pair of retention pieces.

2. The mounting metal fitting of claim 1, wherein at least one of the first mounting section and the second mounting section further includes a joined section to be joined to a substrate.

3. The mounting metal fitting of claim 2, wherein the second mounting section includes the joined section, and in a direction crossing the arrangement direction, a width of the joined section is smaller than an overall width of the second mounting section.

4. The mounting metal fitting of claim 2, wherein the joined section protrudes from the periphery wall along the arrangement direction.

5. A connector, comprising a mounting metal fitting having mounting members to be attached to a housing of a connector, the housing including a bottom wall and a periphery wall surrounding a periphery of the bottom wall, the periphery wall being composed of a pair of first side walls and a pair of second side walls, the pair of first side walls retaining contacts with the contacts aligned in an arrangement direction, one of the pair of second side walls connecting one ends of the pair of first side walls, while another of the pair of second side walls connecting other ends of the pair of first side walls, wherein the mounting members include a first mounting section and a second mounting section, the first mounting section covering at least part of a region, in which no contacts are aligned, of a first side wall that is one of the pair of first side walls, the second mounting section being separated from the first mounting section, the second mounting section covering at least part of a second side wall that is at least one of the pair of second side walls, at least one of the first mounting section and the second mounting section includes a pair of retention pieces and a connection piece, the pair of retention pieces pinching the periphery wall in a thickness direction of the periphery wall, the connection piece connecting one ends of the pair of retention pieces, wherein the housing to which the mounting metal fitting is attached, and the contacts retained by the pair of first side walls.

6. The mounting metal fitting of claim 1, wherein at least one of the first mounting section and the second mounting section includes a void as a gap formed between the connection piece and the housing in a state where the mounting members are attached to the housing.

7. The mounting metal fitting of claim 1, wherein the connection piece includes an inclined section that is be inclined relative to the bottom wall so as to approach the bottom wall toward an inside retention piece from an outside retention piece of the pair of retention pieces.

8. The mounting metal fitting of claim 1, wherein at least one of the pair of retention pieces of the first mounting section includes an extension piece extended in the arrangement direction.

9. The mounting metal fitting of claim 8, further including a bottom piece that is connected to the extension piece and extended along the bottom wall.

10. The mounting metal fitting of claim 9, wherein the first mounting section further includes a joined section to be joined to a substrate, the bottom piece connects the extension piece and the joined section, and part, other than a region in which the extension piece and the joined section are connected, of the bottom piece is provided with a taper.

11. The mounting metal fitting of claim 1, wherein at least one of the pair of retention pieces is configured to, in a state where the contacts joined to a substrate, be in contact with the substrate, at least when the connection piece elastically deforms.

12. The mounting metal fitting of claim 1, wherein an end, on a side of the bottom wall, of a retention piece that is at least one of the pair of retention pieces in at least one of the first mounting section and the second mounting section includes a joined face joined to a substrate with the contacts joined to the substrate.

13. The mounting metal fitting of claim 12, wherein the end, on the side of the bottom wall, of the retention piece that is at least one of the pair of retention pieces in the second mounting section includes the joined face, and in a direction crossing an arrangement direction of the pair of retention pieces, width of the end on the side of the bottom wall in the second mounting section is smaller than width of part, other than the end on the side of the bottom wall, of the pair of retention pieces.

14. The connection system, comprising a connector of claim 5, and a mating connector including mating contacts that are electrically connected to the contacts.

15. The connector of claim 5, further including a power terminal that is retained by the housing to be aligned along with the contacts in the arrangement direction and is to be electrically connected to a power supply, wherein the power terminal is retained by the housing in an order of the first mounting section, the power terminal and the contacts.

16. The connector of claim 15, further including, as the power terminal, a pair of power terminals, and the pair of power terminals is retained by the housing so as to be, in plan view, invariant under a point reflection through a center of the housing.

17. The connector of claim 15, wherein as seen along the arrangement direction, a cross-section of each of the pair of power terminals is the same as a cross-section of each of the contacts.

18. The connector of claim 15, wherein the contacts are configured to be electrically connected to mating contacts of a mating connector, the mating connector comprises a mating-side housing, a mating-side power terminal that is retained by the mating-side housing to be electrically connected to the power terminal, and a mating-side mounting metal fitting that is integrally formed with the mating-side power terminal and attached to the mating-side housing, the mounting metal fitting is attached to the housing so as to be in contact with the mating-side mounting metal fitting in a state where the contacts are electrically connected to the mating contacts, and the power terminal is retained by the housing so as to be in contact with the mating-side power terminal in the state where the contacts are electrically connected to the mating contacts.

19. The connector of claim 5, wherein the housing is insert molded along with the mounting metal fitting as an inserted component.

* * * * *